US009919891B2

(12) United States Patent
Chiba et al.

(10) Patent No.: US 9,919,891 B2
(45) Date of Patent: Mar. 20, 2018

(54) RECORDING APPARATUS

(71) Applicant: SEIKO EPSON CORPORATION, Tokyo (JP)

(72) Inventors: Satoshi Chiba, Suwa (JP); Hidetoshi Kodama, Matsumoto (JP); Toru Tanjo, Shiojiri (JP); Kohei Ueno, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/346,292

(22) Filed: Nov. 8, 2016

(65) Prior Publication Data

US 2017/0050450 A1 Feb. 23, 2017

Related U.S. Application Data

(62) Division of application No. 14/870,877, filed on Sep. 30, 2015, now Pat. No. 9,527,318.

(30) Foreign Application Priority Data

Sep. 30, 2014 (JP) ..... 2014-201241
Jul. 15, 2015 (JP) ..... 2015-141078

(51) Int. Cl.
*B65H 31/26* (2006.01)
*B41J 13/10* (2006.01)
*B41J 11/00* (2006.01)

(52) U.S. Cl.
CPC ..... *B65H 31/26* (2013.01); *B41J 13/106* (2013.01); *B41J 11/0005* (2013.01); *B41J 11/0025* (2013.01)

(58) Field of Classification Search
None
See application file for complete search history.

(56) References Cited

U.S. PATENT DOCUMENTS 6,070,868 A 6/2000 Nagato et al.
6,341,934 B1 1/2002 Takeno et al.
(Continued)

FOREIGN PATENT DOCUMENTS

JP 2001-187666 7/2001
JP 2002-128372 5/2002
JP 2012-180193 9/2012

OTHER PUBLICATIONS

See the attached IP.com query search.*
(Continued)

*Primary Examiner* — Lisa M Solomon
(74) *Attorney, Agent, or Firm* — Workman Nydegger

(57) ABSTRACT

A recording apparatus includes: a mount base having a mount surface on which a sheet discharged through a medium discharge outlet is mounted, the mount surface facing the recording surface of the sheet; a projection rib that is provided in the mount base, is projectable from the mount surface, and extends along a discharge direction of the sheet discharged through the medium discharge outlet, through a center of the sheet in a width direction crossing the discharge direction of the sheet; and a projection mechanism that causes the projection rib to project from the mount surface to a rib height according to a dimension of the sheet in the width direction discharged through the medium discharge outlet.

8 Claims, 15 Drawing Sheets

(56) References Cited

U.S. PATENT DOCUMENTS

| | | | | |
|---|---|---|---|---|
| 2012/0045263 | A1 | 2/2012 | Kimura et al. | |
| 2013/0241979 | A1* | 9/2013 | Iwata | B41J 2/18 347/6 |
| 2016/0089912 | A1 | 3/2016 | Chiba et al. | |

OTHER PUBLICATIONS

U.S. Appl. No. 14/870,877, dated May 25, 2016, Restriction Requirement.
U.S. Appl. No. 14/870,877, dated Sep. 8, 2016, Notice of Allowance.

* cited by examiner

RECORDING APPARATUS

BACKGROUND

1. Technical Field

The present invention relates to a recording apparatus including a recording section that performs recording on a medium.

2. Related Art

In related art, an ink jet printer is known as a type of recording apparatus that includes a recording section which performs recording on a paper sheet which is an example of a medium, and that ejects ink as liquid (recording ink) to a print sheet to be transported, thereby performing printing (recording) an image or the like on a recording area of the paper sheet. In such a printer, a phenomenon may occur in which a paper sheet curls because of the ink which is ejected and adheres to the paper sheet.

Particularly, in a printer including a recording section equipped with a recording head (line head) that is capable of discharging ink over a paper sheet in the width direction crossing the transport direction of the paper sheet, ink is ejected to the entire recording area in the width direction substantially simultaneously, and thus the liquid volume of ink which adheres to the paper sheet for a short time increases. Also, as the printing time decreases, available drying time of a great amount of liquid that adheres to the recording area reduces. For this reason, the paper sheet tends to be curved and likely to assume a curled state. Consequently, a paper sheet on which recording is performed by the recording section is transported from the recording section along the medium transport path, then when the paper sheet is discharged through the medium discharge outlet at the terminal end of the medium transport path, the paper sheet assumes a curled state.

Therefore, it has been demanded to develop a technology that corrects curl which occurs in a paper sheet when the paper sheet is mounted on the mount base. As one of such technologies, an apparatus has been proposed that is provided with a correction rib that forms depressions and projections on the mount surface (medium mount surface) by causing the correction rib to project to multiple levels of height through a slit which is formed in the mount base (recording paper stacker) (for instance, see JP-A-2002-128372).

In recent years, along with enhanced recording speed, the time until a paper sheet is discharged to a mount base after recording is performed by the recording section has been reduced. Therefore, in the recording apparatus, in a paper sheet in which liquid adheres to a recording area, a recording surface to which the liquid adheres normally expands and extends, and thus the recording surface forms a convex surface and the paper sheet is discharged in a curled state (first curled state). Subsequently, drying of the liquid advances and the recording surface shrinks, then the recording surface forms a concave surface this time and resulting in a curled state (second curled state).

However, for a paper sheet in which curl occurs like this, it is a purpose of a technology in related art to ensure the amount of paper sheets mounted on the mount surface. For instance, for each of a paper sheet in the first curled state and a paper sheet in the second curled state, the technology only changes the height of a correction rib according to the amount of mounted paper sheets. Consequently, in related art, there has been a problem in that it is difficult to accurately correct the curl that practically occurs in a paper sheet.

It is to be noted that such actual circumstances are in common with recording apparatuses including a mount base in which a medium, which is discharged through a medium discharge outlet provided at the terminal end of the medium transport path, is mounted on the mount surface that faces the recording surface of the medium in a state where a recording surface on which recording is performed by the recording section faces in a gravitational direction in a vertical direction.

SUMMARY

An advantage of some aspects of the invention is that a recording apparatus capable of accurately correcting curl that occurs in a medium mounted on a mount base is provided.

Hereinafter, a technique for solving the above-mentioned problem and an operational effect will be described. According to a first aspect of the invention, a recording apparatus that solves the above-mentioned problem includes: a recording section that performs recording on a medium by discharging a liquid; a transport path along which the medium, on which recording is performed by the recording section, is transported, the transport path being provided with a discharge outlet through which the medium is discharged with a recording surface on which recording is performed by the recording section immediately before the discharge facing in a gravitational direction in a vertical direction; a mount base having a mount surface on which the medium discharged through the discharge outlet is mounted, the mount surface facing the recording surface of the medium; a rib that is provided in the mount base, is projectable from the mount surface, and extends along a discharge direction of the medium discharged through the discharge outlet, through a center of the medium in a width direction crossing the discharge direction of the medium; and a projection mechanism that causes the rib to project from the mount surface to a rib height according to a dimension of the medium in the width direction discharged through the discharge outlet.

With this configuration, the medium in the mount base is mounted with curl corrected by a rib that is projected to a height according to the dimension of the medium in the width direction, the curl forming a convex surface of the recording surface and occurring when the medium is discharged through the discharge outlet. Consequently, the curl of the medium is accurately correctable by a rib with a height adjusted according to the degree of curl occurred. It is to be noted that in a method of perform recording on the surface of the medium first and recording on the back surface of the medium, the recording surface recorded immediately before by the recording section, indicates the recorded back surface of the medium. In a method of performing recording on one side, the recording surface recorded immediately before by the recording section indicates the recorded one surface of the medium.

It is preferable that the projection mechanism in the above-described recording apparatus adjust the rib height according to a length, along the discharge direction, of the medium discharged through the discharge outlet. With this configuration, the height of the rib that is projected according to the dimension of the medium in the width direction is further adjusted according to the length in the discharge direction. Therefore, curl of the medium is accurately correctable by a rib with a height adjusted according to a degree of the curl that varies with the length in the discharge direction.

It is preferable that the above-described recording apparatus further include a liquid volume rate calculation section that calculates a liquid volume rate of the liquid ejected from the recording section with respect to a maximum liquid volume of the liquid that may be ejected from the recording section, using discharge data that indicates a liquid volume of the liquid which is ejected from the recording section to the medium, and the projection mechanism adjusts the rib height according to the liquid volume rate calculated by the liquid volume rate calculation unit.

With this configuration, for instance when the degree of curl varies according to a volume rate of the liquid that is ejected and adheres to the medium, the curl of the medium is accurately correctable by a rib with a height adjusted appropriately to the degree of curl that occurs according to the liquid volume rate.

It is preferable that the above-described recording apparatus further include a thickness acquisition section that obtains a thickness of the medium on which recording is performed by the recording section, and the projection mechanism adjusts the rib height according to the thickness of the medium obtained by the thickness acquisition section.

With this configuration, when the degree of curl varies according to the thickness of the medium, the curl of the medium is accurately correctable by a rib with a height adjusted according to the degree of curl that occurs according to the thickness.

It is preferable that the projection mechanism in the above-described recording apparatus cause the rib to project so that a rib height set when a long width medium, among the medium, having a long length in the width direction is mounted is higher than a rib height set when a short width medium, among the medium, having a short length in the width direction is mounted.

With this configuration, when the degree of curl increases as the dimension of the medium in the width direction crossing the discharge direction of the medium increases, the curl of the medium is accurately correctable by a rib with a height adjusted according to the dimension in the width direction.

It is preferable that the projection mechanism in the above-described recording apparatus when the short width medium is discharged and mounted in a state where the long width medium is discharged through the discharge outlet and mounted on the mount base, the projection mechanism maintain the rib height without lowering the rib height.

With this configuration, a previously mounted long width medium is corrected to an appropriate curved shape by a rib with a height according to the dimension of the medium in the width direction, and thus by maintaining the rib height, the short width medium discharged next is mounted to overlap with the long width medium and is corrected to an appropriate curved shape.

It is preferable that the above-described recording apparatus further include an air blower that blows air in a direction in which the medium discharged through the medium discharge outlet is pressed toward the mount surface. With this configuration, it is possible to stably mount the discharged medium on the mount base.

According to a second aspect of the invention, a recording apparatus that solves the above-mentioned problem includes: a recording section that performs recording on a medium by discharging a liquid; a transport path along which the medium, on which recording is performed by the recording section, is transported, the transport path being provided with a discharge outlet through which the medium is discharged with a recording surface on which recording is performed by the recording section immediately before the discharge facing in a gravitational direction in a vertical direction; a mount base having a mount surface on which the medium discharged through the discharge outlet is mounted, the mount surface facing the recording surface of the medium; a projection section that is provided in the mount base, projects from the mount surface, and that extends along a discharge direction of the medium discharged through the discharge outlet, through a center of the medium in a width direction crossing the discharge direction of the medium; a rib that is projectable from an upper surface of the projection section; a determination section that makes determination by comparing between a length of the medium in the width direction and a predetermined value; and a controller that causes the rib to project from the projection section when a determination result by the determination section indicates that the length of the medium in the width direction is greater than or equal to a predetermined value, and that controls the rib so that the rib does not project from the projection section when the determination result by the determination section indicates that the length of the medium in the width direction is less than the predetermined value.

With this configuration, when the widthwise length of the medium is longer than or equal to a predetermined value, curl of the medium is correctable.

It is preferable that the above-described recording apparatus further include a detector that detects a maximum loading amount of the mount base, and when the maximum loading amount is detected by the detector in a state where the rib projects from the projection section, the controller lower the rib.

With this configuration, it is possible to increase the maximum loading amount of medium that can be mounted on the mount base.

It is preferable that the controller in the above-described recording apparatus, when the maximum loading amount is detected by the detector in a state where the rib does not project from the projection section, the controller stop printing. With this configuration, a medium is not mounted when the maximum loading amount is exceeded.

It is preferable that the controller in the above-described recording apparatus include a calculation section that calculates a ratio of an area to which the liquid is ejected with respect to a unit area of the medium, using print data, and in the case where a determination result by the determination section indicates that the length of the medium in the width direction is greater than or equal to a predetermined value, when the ratio of the area is greater than or equal to a predetermined value, the controller causes the rib to project from the projection section, when the ratio of the area is less than a predetermined value, the controller does not cause the rib to project from the projection section.

With this configuration, when the widthwise length of the medium is longer than or equal to a predetermined value and a ratio of the area to which liquid is ejected with respect to the unit area of the medium is greater than or equal to a predetermined value, curl of the medium is corrected.

It is preferable that the above-described recording apparatus further include a recording mode that allows selection between a normal image quality mode and a high image quality mode which is higher in quality than the normal image quality mode, and when a determination result by the determination section indicates that the length of the medium in the width direction is greater than or equal to a predetermined value, and the high image quality mode is selected, the controller does not cause the rib to project from the projection section and causes the recording section to perform recording by low-speed transport which is lower in speed than a transport speed in the normal image quality mode.

With this configuration, when the widthwise length of the medium is longer than or equal to a predetermined value and the high quality mode is selected, the media discharged through the discharge outlet are aligned on the mount base.

It is preferable that the above-described recording apparatus further include an alignment mode that is selectable and a plurality of media mounted in a stack on the mount base is aligned, and when a determination result by the determination section indicates that the length of the medium in the width direction is greater than or equal to a predetermined value, and the alignment mode is selected, the controller does not cause the rib to project from the projection section and causes the recording section to perform recording by low-speed transport which is lower in speed than a transport speed when the alignment mode is not selected.

With this configuration, when the widthwise length of the medium is longer than or equal to a predetermined value and the alignment mode is selected, the media discharged from the discharge outlet are aligned on the mount base.

According to a third aspect of the invention, a recording apparatus that solves the above-mentioned problem, includes: a recording section that performs recording on a medium by discharging a liquid; a transport path along which the medium, on which recording is performed by the recording section, is transported, the transport path being provided with a discharge outlet through which the medium is discharged with a recording surface on which recording is performed by the recording section immediately before the discharge facing in a gravitational direction in a vertical direction; a mount base having a mount surface on which the medium discharged through the discharge outlet is mounted, the mount surface facing the recording surface of the medium; a projection section that is provided in the mount base, projects from the mount surface, and that extends along a discharge direction of the medium discharged through the discharge outlet, through a center of the medium in a width direction crossing the discharge direction of the medium; a rib that is projectable from an upper surface of the projection section; a determination section that makes determination by comparing between a grammage of the medium and a predetermined value; and a controller that causes the rib to project from the projection section when a determination result by the determination section indicates that the grammage of the medium is less than a predetermined value, and that controls the rib so that the rib does not project from the projection section when the determination result by the determination section indicates that the grammage of the medium is greater than or equal to the predetermined value.

With this configuration, when the grammage of the medium is lower than or equal to a predetermined value, the curl of the medium is accurately correctable by projecting the rib from the projection portion.

It is preferable that the recording section in the above-described recording apparatus include a line head that may simultaneously eject the liquid over at least a range of recording area in a width direction of the medium crossing a transport direction of the medium which is transported along the transport path.

With this configuration, it is possible to perform recording on the medium at high speed by the line head and to accurately correct the curl that occurs in the medium with the medium mounted on the mount base.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, as an embodiment of a recording apparatus, an ink jet printer will be described with reference to the drawings, the ink jet printer including a recording section that ejects ink which is an example of liquid and being configured to discharge the ink to a sheet of paper which is an example of a sheet-shaped medium, thereby printing (recording) an image including a character or a figure.

First Embodiment

Figure 1:
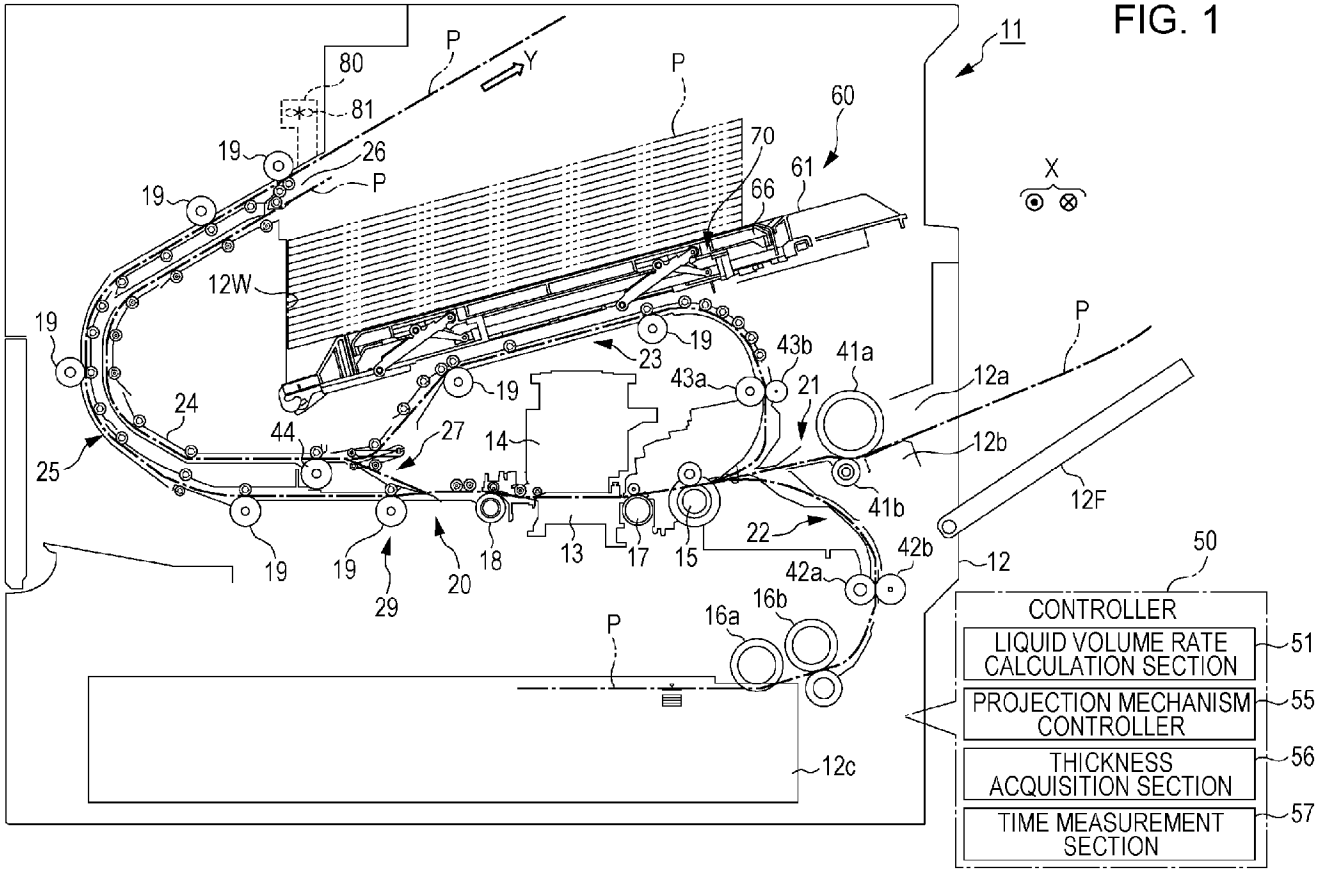
FIG. 1 is a structural diagram schematically illustrating a printer as an example of an embodiment of a recording device.

As illustrated in FIG. 1, a printer 11 as an example of a recording apparatus of the present embodiment includes the following in a substantially rectangular prism-shaped housing 12: a supporting base 13 that supports paper sheet P from the side of the paper sheet P in the gravitational direction, a recording section 14 that prints an image on the paper sheet P, and a medium transport path 20 along which the paper sheet P is transported. In addition, the printer 11 includes a transport section 29 that includes a plurality of rollers (roller pairs) and transports the paper sheet P along the medium transport path 20.

The printer 11 transports the paper sheet P on the supporting base 13 and along the medium transport path 20 where the perpendicular direction to the paper surface in FIG. 1 is the widthwise direction X of the paper and the transport direction is the direction crossing the widthwise direction X. A lower portion of the recording section 14 is provided with a line head that is a liquid discharge head capable of discharging ink simultaneously to substantially the entire area in the width direction X crossing the transport direction of the paper sheet P. The line head transfers ink to the side of paper sheet P in the anti-gravitational direction to print an image, the paper sheet P being transported on the supporting base 13.

The printed paper sheet P is transported from the recording section 14 to the medium transport path 20 by a paper delivery roller pair 18 and other plurality of transport roller pairs 19, and is discharged to the outside of the medium transport path 20 through a medium discharge port 26 provided at the end of the medium transport path 20. Therefore, the transport direction of the paper sheet P to the medium discharge outlet 26 and discharge direction Y of the paper sheet P from the medium discharge outlet 26 are assumed to be the same movement direction. The paper sheet P discharged through the medium discharge outlet 26 in the discharge direction Y indicated by a white arrow in FIG. 1 then falls to the side in the gravitational direction, and is mounted on a mount surface 61 of a mount base 60 with a predetermined maximum number of sheets or less stacked as indicated by chain double-dashed lines in FIG. 1.

The mount base 60 has a rising mount surface 61 that ascends in the anti-gravitational direction toward the discharge direction Y of the paper sheet P, and mounts the paper sheet P on the mount surface 61 in a stacked state. At this point, each paper sheet P mounted on the mount surface 61 moves in the opposite direction to the discharge direction Y along the slope of the mount surface 61, and the paper end on the opposite side to the discharge direction Y side of the paper comes into contact with a vertical side wall 12W provided below the medium discharge outlet 26 of the housing 12, and is positioned as indicated by a chain double-dashed line in FIG. 1.

Furthermore, the housing 12 is provided with an air blower 80 that is located on the downstream side, in the discharge direction Y of the paper sheet P, of the transport roller pairs 19 in the vicinity of the medium discharge outlet 26, and that blows air in the direction in which the paper sheet P discharged through the medium discharge outlet 26 is pressed toward the mount surface 61. The air blower 80 includes a rotary fan 81. It is to be noted that in the present embodiment, a pair of air blowers 80 is provided in the width direction X of the paper sheet P so that the air blowing ports centered on a projection section 62 of the mount surface 61 are opposed to both ends of the paper sheet P in the width direction X (see FIG. 2). One air blower 80 may be originally provided and the air blowing ports thereof may have a continuous shape in the width direction X of the paper sheet P.

In the present embodiment, the medium transport path 20 has a medium discharge path 25 along which the paper sheet P is transported from the recording section 14 to the medium discharge outlet 26, and a medium supply path along which the paper sheet P is supplied to the recording section 14. The medium supply path includes a first medium supply path 21, a second medium supply path 22, and a third medium supply path 23.

During a period until the paper sheet P printed by the recording section 14 is transported to the medium discharge outlet 26, the medium discharge path 25 curves the recording surface inwardly, which is the sheet surface of the paper sheet P printed by the recording section 14, and the medium discharge path 25 has a curve reverse path along which the paper sheet P is reversed from a state where the recording surface of the paper sheet P faces in the anti-gravitational direction to a state where the recording surface faces in the gravitational direction. Therefore, the paper sheet P is passed through the curve reverse path in the medium discharge path 25, and the recording surface recorded by the recording section 14 becomes opposed to the mount surface 61 of the mount base 60 immediately before the paper sheet P is transported to the medium discharge outlet 26, and the paper sheet P is discharged from medium discharge outlet 26.

In the first medium supply path 21, paper sheet P inserted through an insertion slot 12*a* is transported to the recording section 14, the insertion slot 12*a* being exposed by opening a cover 12F provided on a lateral side of the housing 12. In other words, the paper sheet P inserted through the insertion slot 12*a* is pressed against a first drive roller 41*a* by a hopper 12*b*, transported by the rotational drive of the first drive roller 41*a*, pinched between the first drive roller 41*a* and a first driven roller 41*b*, then transported toward the recording section 14 by the rotational drive of the first drive roller 41*a*.

In the second medium supply path 22, the paper sheet P stackably mounted on a paper cassette 12*c* is transported to the recording section 14, the paper cassette 12*c* being removably provided at the base of the housing 12 in the gravitational direction. In other words, among paper sheets P mounted on the paper cassette 12*c* in a stacked state, the uppermost paper sheet P is delivered by a pickup roller 16*a*, separated piece by piece by a separation roller pair 16*b*, then pinched between a second drive roller 42*a* and a second driven roller 42*b*, and transported toward the recording section 14 by the rotational drive of the second drive roller 42*a*.

In the third medium supply path 23, when double-sided print is performed on the paper sheet P for the sheet surfaces (paper surfaces) on both sides, paper sheet P with the sheet surface on one side already printed by the recording section 14 is transported to the recording section 14 again. In other words, the downstream side the recording section 14 in the transport direction of the paper sheet P is provided with a branch transport path 24 that is branched from the medium discharge path 25 by the operation of a branching mechanism 27 which is provided midway along the medium discharge path 25. The branch transport path 24 is provided with a branch transport path roller pair 44 on the downstream side of the branching mechanism 27, the branch transport path roller pair 44 being rotatable in both forward and reverse rotation.

When double-sided print is performed, paper sheet P with the sheet surface on one side printed is once transported to the branch transport path 24 from the recording section 14 toward the mount base 60 by the branch transport path roller pair 44 in forward rotation. At this point, when part of the end of paper sheet P, in the transport direction, transported to the branch transport path 24 jumps out from the medium discharge outlet 26, a jump out position is set so that the paper sheet P does not come into contact with the paper sheets P mounted on the mount base 60.

Subsequently, the paper sheet P transported to the branch transport path 24 is reversely transported from the mount base 60 to the recording section 14 along the branch transport path 24 by the branch transport path roller pair 44 in reverse rotation. At this point, the reversely transported paper sheet P is transported to the third medium supply path 23, and transported toward the recording section 14 by the plurality of transport roller pairs 19. The transport of the paper sheet P to the third medium supply path 23 causes unprinted sheet surface thereof to be reversed to face the recording section 14, the paper sheet P is pinched between a third drive roller 43*a* and a third driven roller 43*b*, and is transported toward the recording section 14 by the rotational drive of the third drive roller 43*a*.

The paper sheet P transported toward the recording section 14 along the medium supply paths is transported to an alignment roller pair 15 disposed on the upstream side of the recording section 14 in the transport direction, then the end of the paper sheet P collides with the alignment roller pair 15 which has stopped its rotation. Then, an inclination to the transport direction is corrected (skew removal) by a state of such collision of the paper sheet P with the alignment roller pair 15. The paper sheet P with the inclination corrected is aligned by the subsequent rotational drive of the alignment roller pair 15 and is transported to the recording section 14.

The paper sheet transported to the recording section 14 by the alignment roller pair 15 is transported while being opposed to the recording section 14 by a paper feed roller pair 17 disposed on the upstream side of the recording section 14 in the transport direction, and the paper delivery roller pair 18 and the transport roller pair 19 disposed on the downstream side of the recording section 14 in the transport direction. Ink is ejected to the transported paper sheet P from the opposed recording section 14 and printing is performed.

The printer 11 includes a controller 50 having computer functions, and a storage section (not illustrated) that stores programs that control the print operations described above. The controller 50 is operated in accordance with the programs stored in the storage section, and thereby the operations of the recording section 14 and the transport section 29 are controlled based on print data inputted to the printer 11, and an image is printed (recorded) on the paper sheet P.

Figure 2:
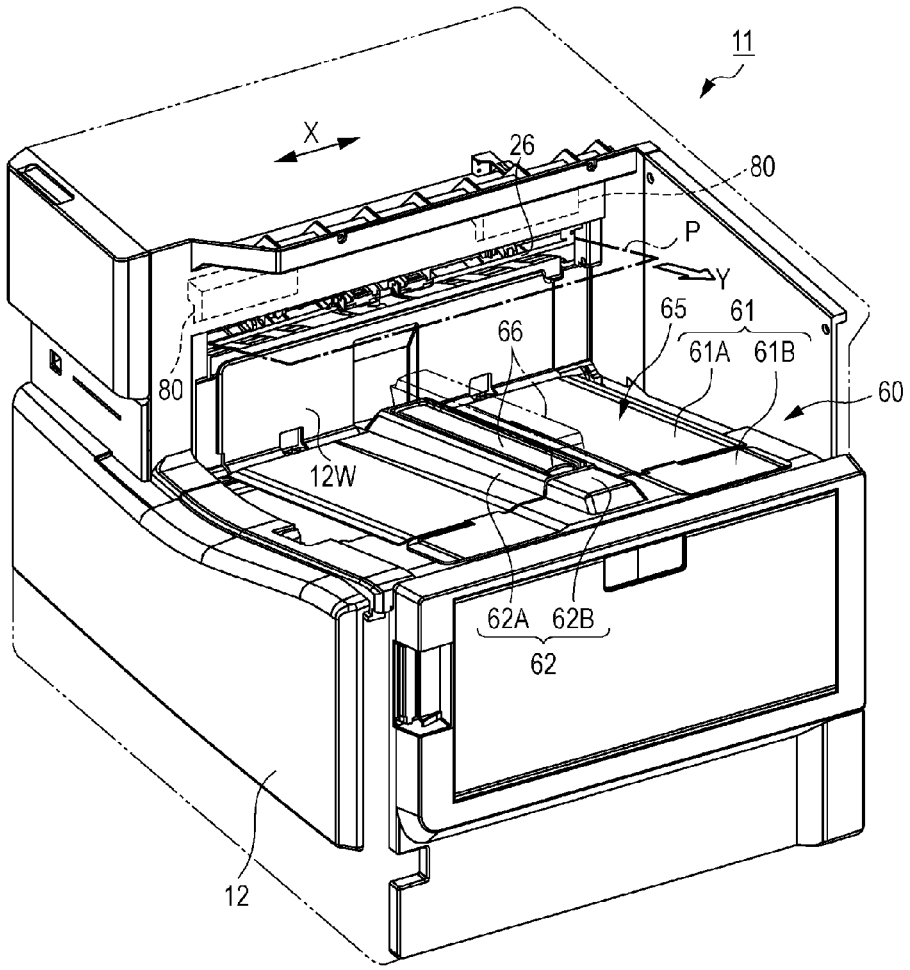
FIG. 2 is a structural perspective view of a printer illustrating part of housing structure including a mount base of sheets.

As illustrated in FIG. 1 and FIG. 2, the mount base 60 in which paper sheets P discharged through the medium discharge outlet 26 are mounted is provided with a projection rib 66 that can project upward from the mount surface 61, and a projection mechanism 70 that causes the projection rib 66 to project to a predetermined rib height from the mount surface 61. The projection mechanism 70 operates in accordance with operation control of a drive source performed by the controller 50 of the printer 11.

As illustrated in FIG. 2, the mount surface 61 of the mount base 60 in the present embodiment includes first mount surfaces 61A on the upstream side and second mount surfaces 61B on the downstream side in the discharge direction Y of the paper sheet P. The first mount surfaces 61A and the second mount surfaces 61B are provided with a first projection section 62A and a second projection section 62B that have a predetermined width in the center in the width direction X crossing the discharge direction Y of the paper sheet P discharged through the medium discharge outlet 26, extend in a longitudinal direction which is a direction along the discharge direction Y of the paper sheet P, and have a predetermined dimensional height in the anti-gravitational direction. The first projection section 62A and the second projection section 62B are provided so as to overlap when viewed in the longitudinal direction, and one projection section 62, which is continuous in the discharge direction Y, is formed on the mount surface 61.

In the present embodiment, the first mount surfaces 61A are each the upper surface of the mount base unit 65 in the gravitational direction, which is removal from the printer 11, and the projection mechanism 70 is attached to and provided in the mount base unit 65. The operation of the projection mechanism 70 causes the projection rib 66 to project upward to a predetermined rib height from the upper surface of the first projection section 62A provided on the first mount surfaces 61A as indicated by chain double-dashed lines in FIG. 2.

Figure 3A:
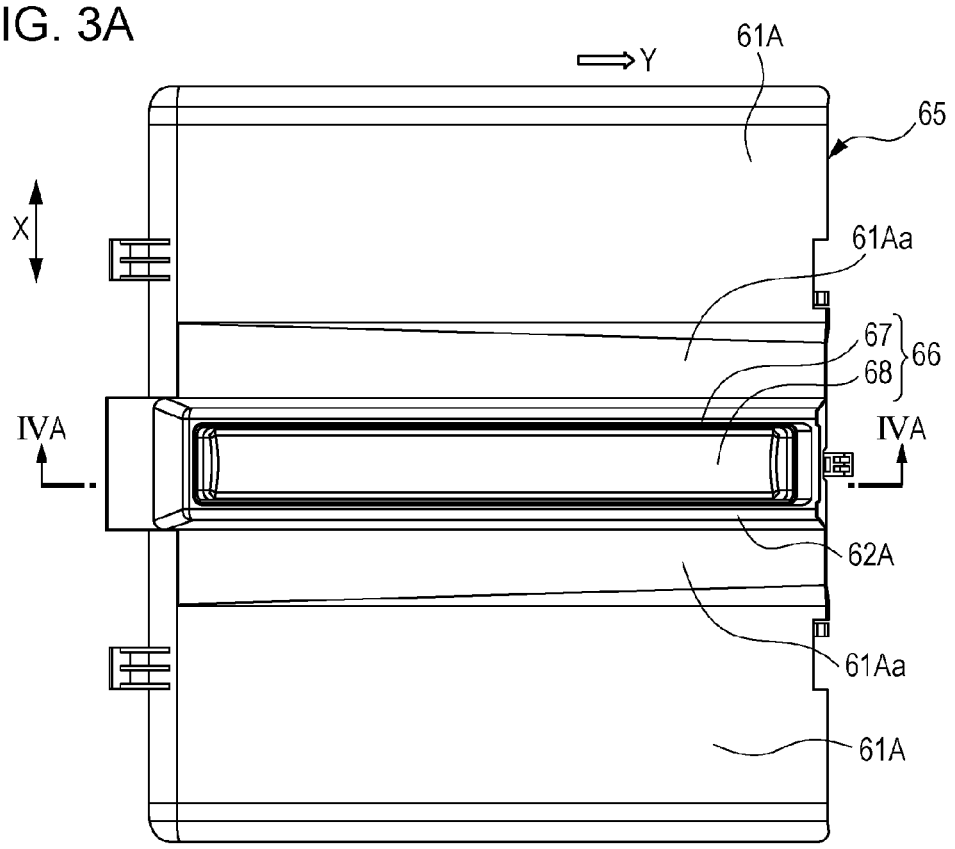
FIG. 3A is a plan view of a mount base section including the mount base of sheets.

Next, the mount base unit 65 will be described with reference to FIGS. 3A, 3B, 3C. As illustrated in FIG. 3A, in the mount base unit 65, the first projection section 62A is provided in substantially the center of the first mount surfaces 61A in the same widthwise direction X as that of the paper sheet P, and in the first projection section 62A, the projection rib 66 is provided that is movable vertically along the normal direction to the first mount surfaces 61A by the operation of the projection mechanism 70. It is to be noted that the portions located on both sides of the first projection section 62A on the first mount surface 61A in the width direction X are inclined surfaces 61Aa that gradually rise toward the downstream side in the discharge direction Y, and a step portion and a mount surface (upper surface) provided on both sides of the second projection section 62B of the second mount surfaces 61B in the width direction X are connected.

Figure 3B:
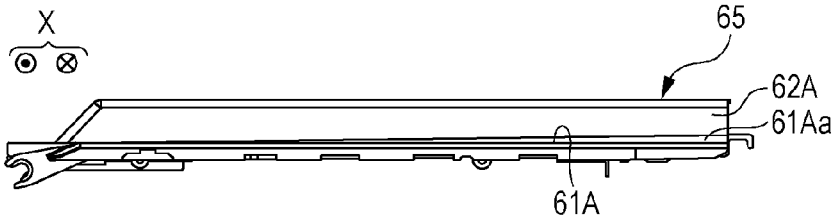
FIG. 3B is a side view of the mount base.

As illustrated in FIG. 3B, in a state where the projection rib 66 is at the lowest, the projection rib 66 is located such that the projection rib 66 is not projected from the upper surface of the first projection section 62A when viewed in the width direction X along the first mount surface 61A. It is to be noted that, in the present embodiment, the projection rib 66 is such that the upper surface thereof matches with the upper surface of the first projection section 62A.

Figure 3C:
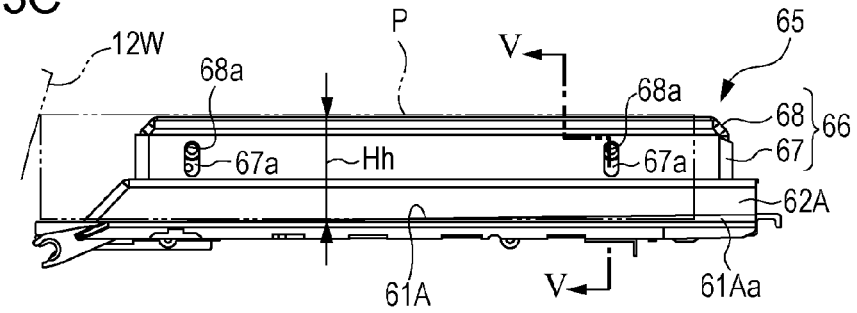
FIG. 3C is a side view of the mount base.

On the other hand, as illustrated in FIG. 3C, in a state where the projection rib 66 is at the highest, the projection rib 66 is located such that the projection rib 66 is projected from the first mount surface 61A by a rib height of dimension Hh when viewed in the width direction X along the first mount surface 61A. This may also referred to as a projection amount by which the projection rib 66 is projected from the first mount surface 61A. In a state where the paper sheet P comes into contact with the vertical side wall 12W and positioned, the projection rib 66 (top rib 68) projecting from the first mount surface 61A is provided to have a length extended from the paper sheets P (indicated by the chain double-dashed lines in FIG. 1 and FIG. 3C) mounted on the first mount surface 61A (mount surface 61) to the downstream side of the paper sheet P in the discharge direction Y.

Also, as illustrated in FIGS. 3A and 3C, in the present embodiment, in a state where the projection rib 66 is projected from the upper surface of the first projection section 62A, the projection rib 66 has two rib members: a frame rib 67 that forms the lateral faces of the projection rib 66 and a top rib 68 that forms the top face of the projection rib 66. In the frame rib 67, both sides walls in the width direction X are provided with total of four oblong holes 67*a* at a predetermined interval in the discharge direction Y. The top rib 68 is provided with four circular pins 68*a* that are respectively located in the four oblong holes 67*a*. Then engagement of the circular pin 68*a* in the vertical direction in each of the oblong holes 67*a* allows the frame rib 67 to move vertically in conjunction with vertical movement of the top rib 68 by the projection mechanism 70.

The configuration of the projection mechanism 70 and the projection rib 66 will be described with reference to FIGS. 4A, 4B and 5. It is to be noted that FIG. 4A illustrates a state where the projection rib 66 is at the lowest, and FIG. 4B and FIG. 5 illustrate a state where the projection rib 66 is at the highest.

Figure 4A:
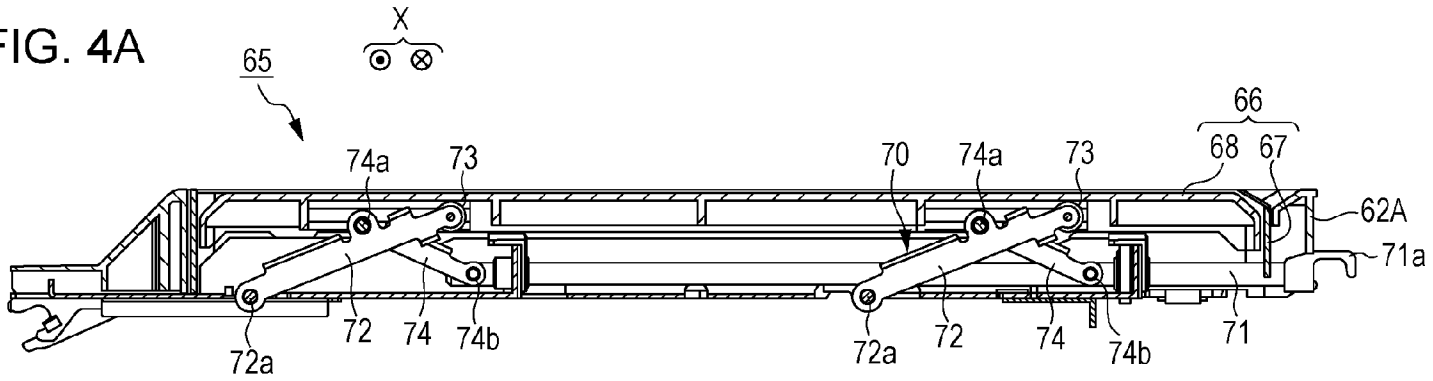
FIG. 4A is a sectional view taken along line IVa-IVa in FIG. 3A and illustrates a state in which a projection rib is not projected.

As illustrated in FIG. 4A, the projection mechanism 70 is formed by a link mechanism. The link mechanism includes a moving bar 71 that is movable in the longitudinal direction of the first projection section 62A, which is the horizontal direction of the paper surface in FIG. 4A, first link plates 72, and second link plates 74. Each of the first link plates 72 is pivotally supported by the mount base unit 65 in a freely rotatable manner by a shaft section 72*a* provided at one end of the first link plate 72, and a roller 73, which is in contact with the top rib 68 of the projection rib 66, is pivotally supported by the other end. Each of the second link plates 74 is pivotally supported by the first link plate 72 in a freely rotatable manner by a shaft section 74*a* provided at one end of the second link plate 74, and is rotatably pivotally supported by the moving bar 71 by a shaft section 74*b* provided at the other end.

A pair of the first link plate 72 and the second link plate 74 is provided to pinch the moving bar 71 in the width direction X (the perpendicular direction to the paper surface in FIGS. 4A and 4B) crossing the longitudinal direction of the first projection section 62A. Both sides of the roller 73 in the width direction X in contact with the top rib 68 are pivotally supported by a pair of the first link plates 72 in a freely rotatable manner. The both sides of the moving bar 71 in the width direction X rotatably pivotally support the other ends of the second link plates 74. Two pieces of the link mechanism configured in this manner are provided at a predetermined interval in the longitudinal direction of the first projection section 62A. Those two link mechanisms constitute the projection mechanism 70 that causes the projection rib 66 to project to a predetermined rib height from the mount surface 61A.

Figure 4B:
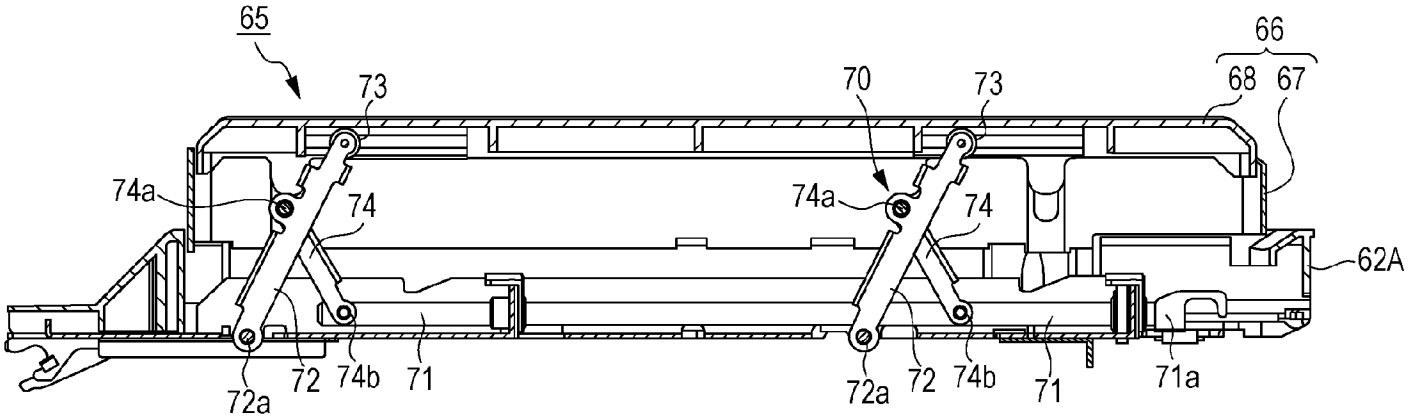
FIG. 4B is a sectional view taken along line IVa-IVa in FIG. 3A and illustrates a state in which a projection rib is projected to a maximum rib height.
Figure 5:
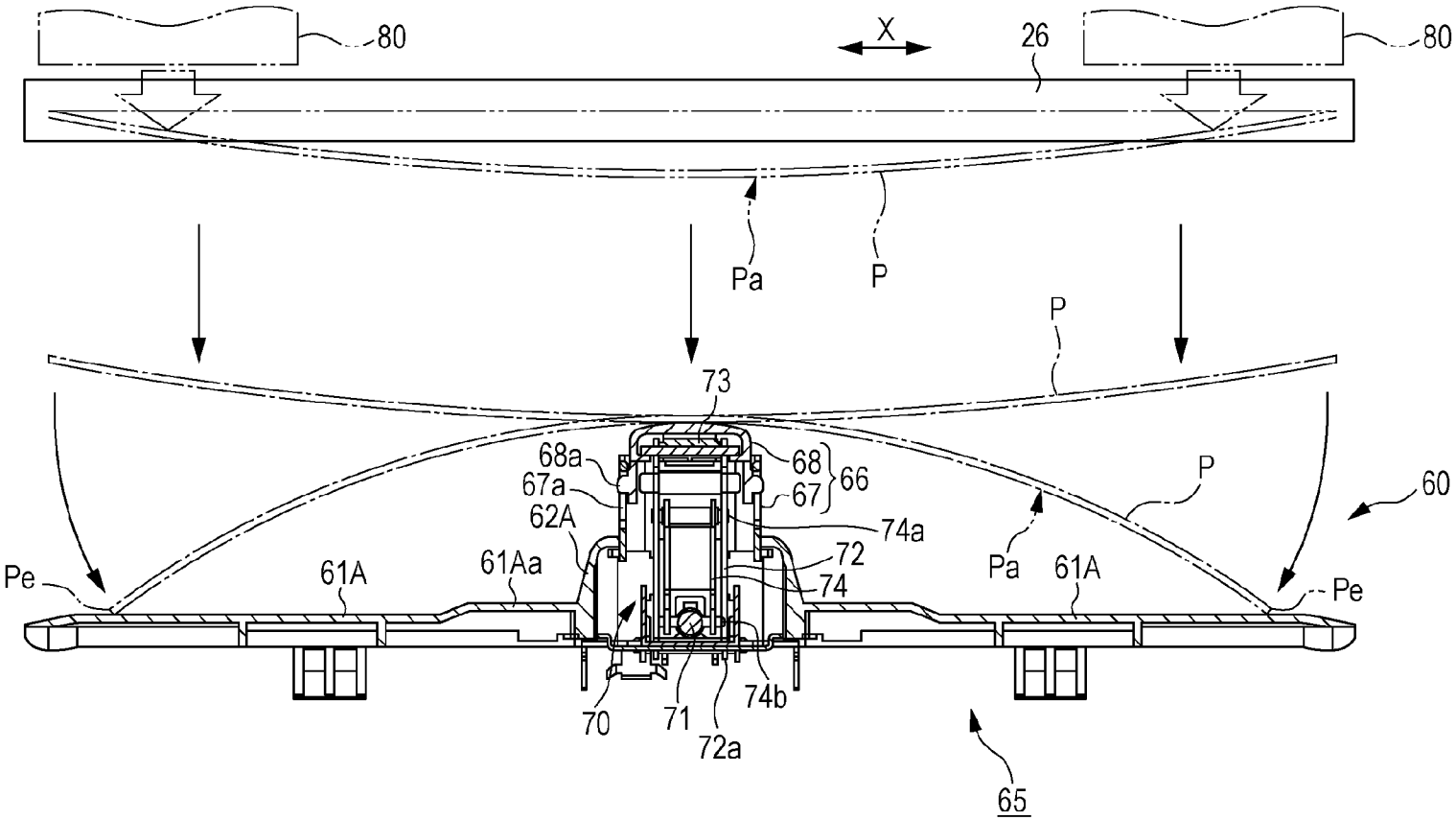
FIG. 5 is a sectional view of a mount base section as seen from the side of the mount base in the direction of discharging sheet, the sectional view being taken along line V-V in FIG. 3C.

As illustrated in FIG. 4B and FIG. 5, in the two link mechanisms of the projection mechanism 70 configured in this manner, when the moving bar 71 is pressed in the opposite direction to the discharge direction Y in a state where the projection rib 66 illustrated in FIG. 4A is not projected, the shaft sections 74*b* of the second link plates 74 pivotally supported on both sides of the moving bar 71 in the width direction X move together with the moving bar 71. Then, the first link plate 72, for which the second link plate 74 is pivotally supported by the shaft section 74*a*, is pressed by the second link plate 74 via the shaft section 74*a*, and thereby the first link plate 72 rotates around the shaft section 72*a* pivotally supported on the mount base unit 65.

The rotation of the first link plate 72 causes the roller 73 rotatably pivotally supported at its other end to rise, and the rising roller 73 lifts the top rib 68 while having contact with the inner top surface of the top rib 68. At this point, the respective rollers 73 rise together in the two link mechanisms, and thereby the top rib 68 is lifted substantially horizontally. The circular pins 68*a* of the lifted top rib 68 come into contact with and are engaged with the upper arc portions of the oblong holes 67*a* of the frame rib 67, and thus the top rib 68 rises while lifting the frame rib 67 together. In this manner, the lift of the top rib 68 and the frame rib 67 causes the projection rib 66 to project to a predetermined rib height from the first mount surface 61A. By moving the moving bar 71 in the opposite direction to the discharge direction Y with the projection rib 66 projected, the top rib 68 and the frame rib 67 are lowered and the rib height of the projection rib 66 becomes low.

In the present embodiment, a hook-shaped section 71*a* provided at the end of the moving bar 71 in the discharge direction Y is driven by the control of the controller 50 and is engaged with a displacement section (not illustrated) and displaced together, the displacement section being displaced in the longitudinal direction of the first projection section 62A, and thereby the moving bar 71 moves back and forth in the longitudinal direction of the first projection section 62A along the discharge direction Y. In this manner, the projection mechanism 70 operates in such a manner that the controller 50 functions as a projection mechanism controller 55 (see FIG. 1).

As illustrated in FIG. 5, in the present embodiment, in a state where the projection rib 66 is at the highest, paper sheet P having a maximum widthwise dimension discharged through the medium discharge outlet 26 is supported at a central portion by the upper surface of the top rib 68 and is mounted with outer peripheral edges Pe on both sides of the paper sheet P in the width direction X supported by the first mount surface 61A. Consequently, although the recording surface Pa forms a convex surface as indicated by chain double-dashed lines in FIG. 5 when the paper sheet P is discharged through the medium discharge outlet 26, the paper sheet P mounted on the mount base 60 is curved such that the recording surface Pa facing the first mount surface 61A forms a concave surface, and thus the curl of the paper sheet P is corrected.

In the present embodiment, a pair of air blowers 80 provided at a predetermined interval in the width direction X of the paper sheet P is configured to blow air down to the paper sheet P which is discharged through the medium discharge outlet 26 as indicated by a white chain double-dashed line arrow in FIG. 5. In other words, the air blown from the air blowers 80 hits the paper sheet P, and both ends of the paper sheet P in the width direction X are thereby pressed down to come into contact with the first mount surface 61A with the paper sheet P centered on the projection rib 66. Consequently, the paper sheet P is likely to be curved on the mount base 60 so that the recording surface Pa forms a concave surface. Although description of the configuration is omitted here, the position at which air hits is designed to be changeable so that the air blower 80 is able to properly press the paper sheet P against the first mount surface 61A according to the widthwise dimension of the paper sheet P.

Next, the operation of the printer 11, that is, the processing of correcting curl of the paper sheet P to be performed when printed paper sheet P is discharged to the mount base 60 will be described with reference to FIG. 6. It is to be noted that the processing is performed in such a manner that the controller 50, which controls the print operation of the printer 11, operates the movement mechanism of the recording section 14 and the transport section 29 in accordance with a predetermined program while properly controlling those sections. Specifically, in the correction processing, the controller 50 functions as a projection mechanism controller 55 that controls the projection mechanism that adjusts the rib height of the projection rib 66, and functions as a liquid volume rate calculation section 51 that calculates a volume rate of the ink ejected from the recording section 14 with respect to a maximum liquid volume of the ink that can be ejected from the recording section 14, based on discharge data. In addition, as necessary, the controller 50 functions as a thickness acquisition section 56 that obtains the thickness of the paper sheet P discharged through the medium discharge outlet 26 and also functions as time measurement section 57 that measures an elapsed time since the paper sheet P is mounted on the mount surface 61 (see FIG. 1).

Figure 6:
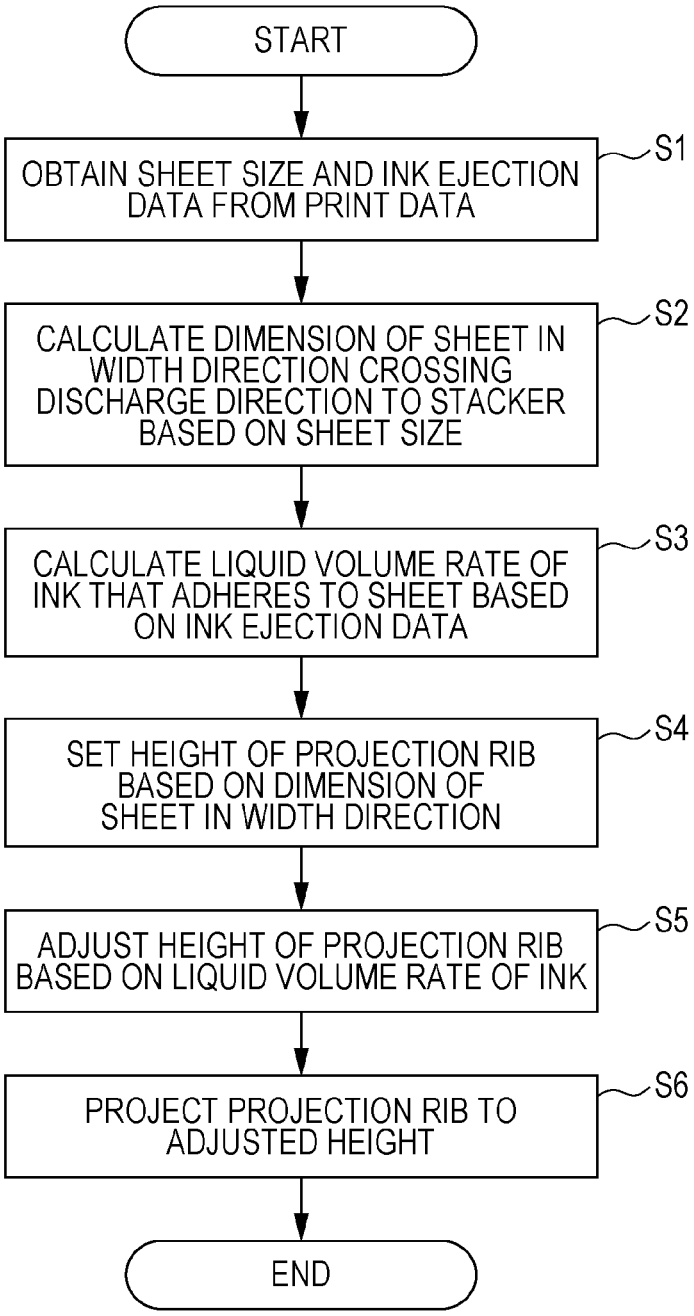
FIG. 6 is a flow chart illustrating print processing.

As illustrated in FIG. 6, when the processing is started, first in step S1, processing of obtaining a sheet size and discharge data of ink from print data is performed. The controller 50 obtains the size of paper sheet P transported to the recording section 14, that is, the type of the paper sheet P, and the orientation of the paper sheet P to the transport direction (for instance, A4 landscape orientation). It is to be noted that the controller 50 functions as the acquisition section 56 and also obtains the thickness of the paper sheet P transported to the recording section 14.

Next, in step S2, processing of calculating the dimension of the paper sheet P in the width direction crossing the discharge direction Y to the mount base 60 is performed based on the obtained sheet size. In the present embodiment, the transport direction of the paper sheet P and the discharge direction Y are assumed to be the same moving direction. Therefore, the controller 50 calculates the dimension of the paper sheet P in the width direction crossing the discharge direction based on the obtained type and orientation of the paper sheet P to the transport direction, the width direction indicating the width direction X, the discharge direction indicating the discharge direction Y. For instance, when the sheet size is the A4 landscape orientation, the controller 50 calculates the dimension of the paper sheet P to be 297 mm in the width direction X crossing the discharge direction Y.

Next, in step S3, processing of calculating a volume rate of the ink that adheres to the paper sheet is performed based on the obtained discharge data of ink. Here, the controller functions as liquid volume rate calculation section 51, and calculates a liquid volume rate (%) of the ink ejected from the recording section 14 to the paper sheet P with respect to a maximum liquid volume of the ink that can be ejected from the recording section 14 to the paper sheet P, based on the discharge data of ink obtained from print data. In short, the controller calculates a print duty. It is to be noted that the maximum liquid volume of ink indicates the liquid volume of ink ejected from the recording section 14 in the case where dots are formed on the paper sheet P with a maximum number of dots.

Next, in step S4, processing of setting the height of the projection rib 66 is performed based on the dimension of the paper sheet P in the width direction. Here, the controller 50 reads and sets a value corresponding to the dimension of the paper sheet P in the width direction X from a rib height setting table (not illustrated) which is stored in the storage section. In the present embodiment, a value corresponding to the dimension of each of the paper sheets P in the width direction X is set so that the rib height set when long width paper sheet P1 is mounted as the long width medium having a long length in the width direction X is higher than the rib height set when short width paper sheet P2 among paper sheets P is mounted as the short width medium having a short length in the width direction X.

Next, in step S5, processing of adjusting the height of the projection rib 66 is performed based on the liquid volume rate of ink. Here, the controller 50 adjusts the value of the set rib height of the projection rib 66 according to the print duty calculated in step S3, based on an adjustment value table (not illustrated) which is stored in the storage section and which indicates an adjustment value of rib height according to a print duty. In the next step S6, processing of projecting the projection rib 66 to the adjusted rib height and the processing of correcting the curl of the paper sheet P is completed.

The processing in step S6 will be described with reference to FIGS. 7A and 7B. It is to be noted that FIGS. 7A and 7B illustrate the projection rib 66 with a rib height before the rib height adjustment processing in step S5 is performed.

Figure 7A:
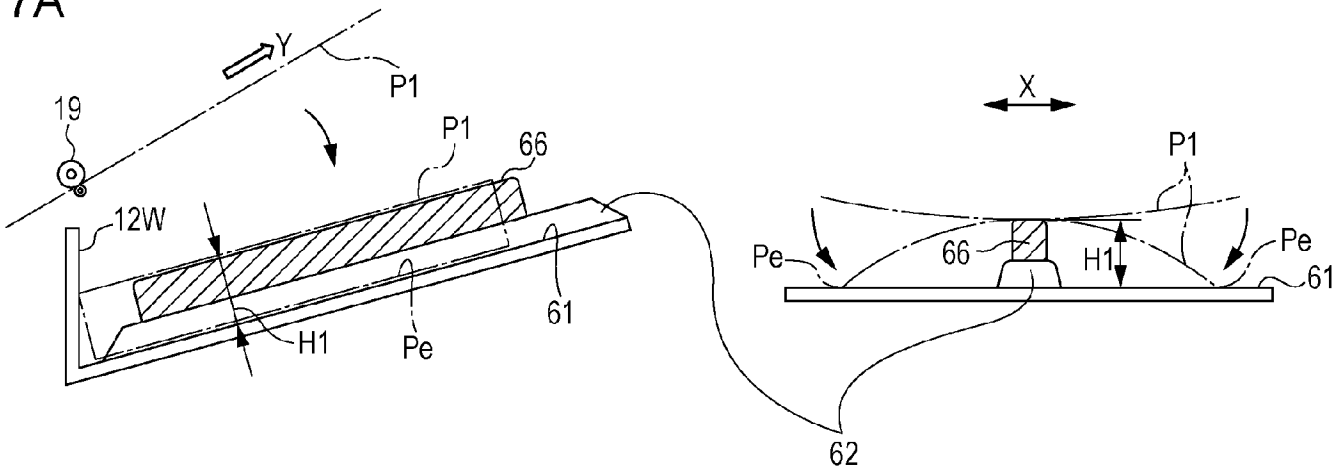
FIG. 7A is a schematic diagram illustrating a mounted state of sheets with a longer width in the mount base.
Figure 7B:
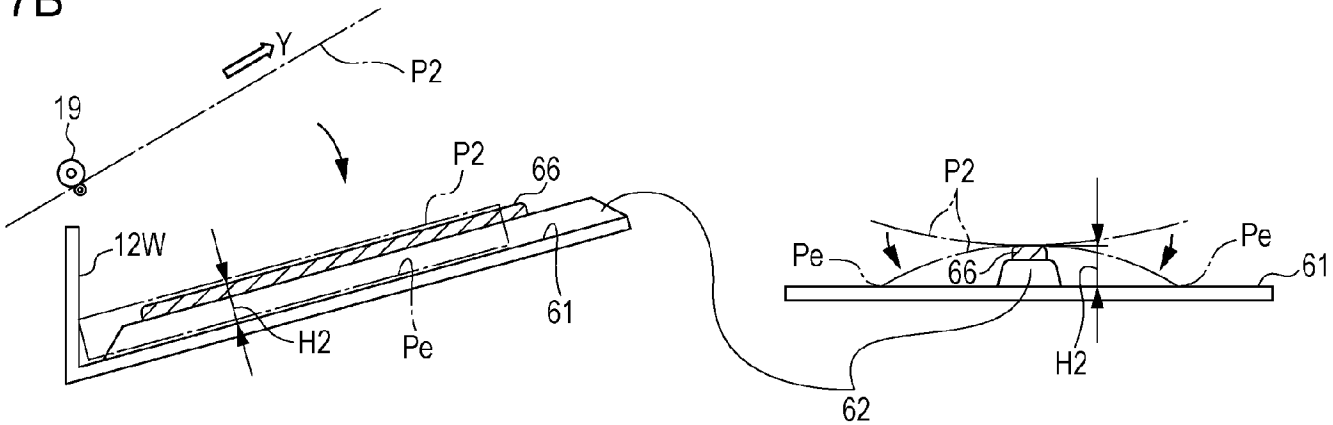
FIG. 7B is a schematic diagram illustrating a mounted state of sheets with a shorter width in the mount base.

As illustrated in FIG. 7A, when long width paper sheet P1 is discharged and mounted, for the projection rib 66 projecting from the mount surface 61 (specifically, the projection section 62), the rib height from the mount surface 61 is set to dimension H1. On the other hand, as illustrated in FIG. 7B, when short width paper sheet P2 is discharged and mounted, for the projection rib 66 projecting from the mount surface 61 (specifically, the projection section 62), the rib height from the mount surface 61 is set to dimension H2 which is smaller than the dimension H1.

In the present embodiment, the rib height of the projection rib 66 is set to be higher as the widthwise dimension of the paper sheet P increases in this manner. The projection rib 66 projects to the rib height set in this manner from the mount surface 61, and thereby the curved shape of the long width paper sheet P1 mounted on the mount surface 61 and the curved shape of the short width paper sheet P2 mounted on the mount surface 61 each have a curved shape having approximately the same curvature radius.

In other words, in the paper sheet P for which the recording surface Pa forms a curled convex surface, the degree of the curl increases as the dimension in the width direction X crossing the discharge direction Y increases. In such a case, a central portion of the paper sheet P in the width direction X is supported by the projection rib 66 with a rib height adjusted according to the dimension in the width direction X, and the outer peripheral edges Pe in the width direction X are mounted and supported on the mount surface 61. Thus, even when the magnitude (length) of the widthwise dimension of the paper sheet P varies, a curled surface is bent toward the opposite side with the same curvature to form a concave surface, and the curl (first curl) occurs in the paper sheet P is accurately corrected.

It is to be noted that when the processing in step S5 is performed for the rib height of the projection rib 66, the rib height of the projection rib 66 for the long width paper sheet P1 illustrated in FIG. 7A and the rib height of the projection rib 66 for the short width paper sheet P2 illustrated in FIG. 7B are each adjusted according to the calculated print duty.

In the present embodiment, description by illustration is omitted. When the print duty is a reference value (for instance, 16%), the rib height is set to the dimension H1 (H2). When the print duty is greater than the reference value, the degree of curl increases, and thus the dimension H1 (H2) is adjusted to be larger according to an increase in the print duty in a range where the dimension H1 (H2) falls below a maximum dimension Hh (see FIG. 3C). On the other hand, when the print duty is less than the reference value, the degree of curl decreases, and thus the dimension H1 (H2) is adjusted to be smaller according to a decrease in the print duty in a range of value where the projection rib 66 (top rib 68) does not project from the projection section 62.

According to the above-described embodiment, the effects presented below can be obtained. (1) The paper sheet P on the mount base 60 is mounted with curl corrected by the projection rib 66 that is projected to a height according to the dimension (widthwise dimension) of the paper sheet P in the width direction X, the curl forming a convex surface of the recording surface Pa and occurring when the paper sheet P is discharged through the medium discharge outlet 26. Consequently, for the printer 11, the curl of the paper sheet P is accurately correctable by the projection rib 66 with a height adjusted appropriately to the degree of the curl that occurs.

(2) For instance, when the degree of curl of the paper sheet P changes according to the volume rate (print duty) of the ink that is ejected and adheres to the paper sheet P, the curl of the paper sheet P is accurately correctable by the projection rib 66 with a height adjusted appropriately to the degree of the curl that occurs according to the volume rate.

(3) When the degree of curl increases as the dimension of the paper sheet P in the width direction X crossing the discharge direction Y increases, the curl of the paper sheet P is accurately correctable by the projection rib 66 with a height adjusted according to the dimension of the paper sheet P in the width direction X.

(4) Because the projection rib 66 is provided to have a length extended from the paper sheet P mounted on the mount surface 61 to the downstream side of the paper sheet P in the discharge direction Y, the curl of the paper sheet P mounted on the mount surface 61 is accurately correctable over the entire area in the discharge direction Y.

(5) It is possible to perform printing (recording) on the paper sheet P at high speed by the line head and to accurately correct the curl that occurs in the paper sheet P with the paper sheet P mounted on the mount base 60. (6) It is possible to stably mount discharged paper sheet P on the mount surface 61 by the air blow from the air blower 80.

It is to be noted that the aforementioned embodiment may be modified to another embodiment as follows. In the aforementioned embodiment, when the short width paper sheet P2 is discharged and mounted with the long width paper sheet P1 discharged through the medium discharge outlet 26 and already mounted on the mount base 60, the projection mechanism 70 preferably maintains the rib height without lowering the rib height. This modification will be described with reference to the drawings.

Figure 8A:
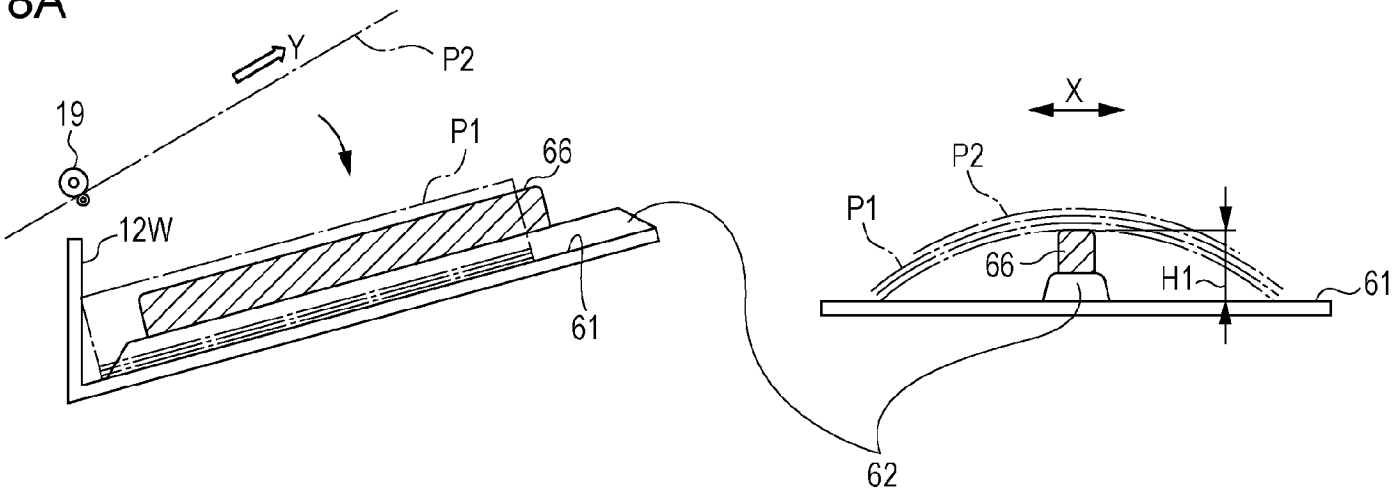
FIG. 8A is a schematic diagram illustrating a state where sheets with a shorter width are mounted in the mount base where sheets with a longer width are mounted.

As illustrated in FIG. 8A, when one or more long width paper sheets P1 are already discharged and mounted on the mount surface 61 of the mount base 60, for the projection rib 66 projecting from the mount surface 61 (specifically, the projection section 62), the rib height from the mount surface 61 is set to the dimension H1. When the short width paper P2 is discharged and mounted subsequently in this state, the projection rib 66 projecting from the mount surface 61 is not lowered and maintained at the dimension H1 of rib height from the mount surface 61.

In other words, when the short width paper sheet P2 having a smaller dimension in the width direction X is discharged on the long width paper sheet P1 having a larger dimension in the width direction X is discharged, the long width paper sheet P1 previously discharged and mounted serves as a support, and thus it is possible to stably mount the short width paper sheet P2 along the curved shape of the long width paper sheet P1 without lowering the projection rib 66. Consequently, the short width paper sheet P2 is bent with substantially the same curvature radius as that of the mounted long width paper sheet P1.

Figure 8B:
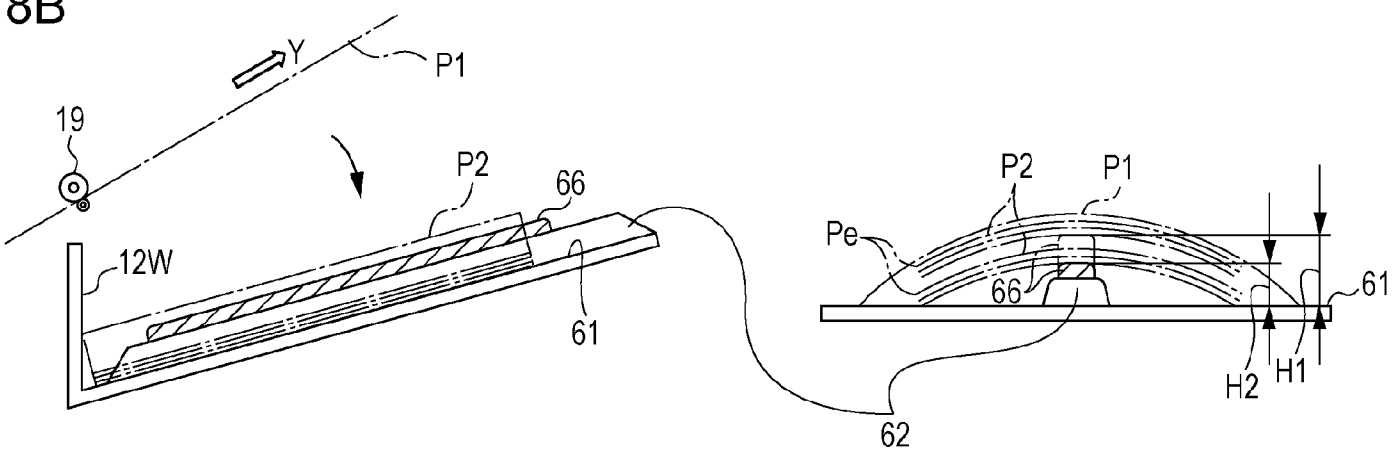
FIG. 8B is a schematic diagram illustrating a state where sheets with a longer width are mounted in the mount base where sheets with a shorter width are mounted.

On the other hand, as illustrated in FIG. 8B, when one or more short width paper sheets P2 are already discharged and mounted on the mount surface 61 of the mount base 60, for the projection rib 66 projecting from the mount surface 61 (specifically, the projection section 62), the rib height from the mount surface 61 is set to the dimension H2 which is smaller than the dimension H1. When the long width paper P1 is discharged and mounted subsequently in this state, the projection rib 66 projecting from the mount surface 61 (specifically, the projection section 62) is elevated so that the rib height from the mount surface 61 is changed from the dimension H2 to the dimension H1. Consequently, the long width paper sheet P1 is bent with substantially the same curvature radius as that of the short width paper sheet P2. In this case, it is to be noted that as the projection rib 66 is elevated, the outer peripheral edges Pe of the already mounted short width paper sheet P2 are separated from the mount surface 61, and thus the short width paper sheet P2 is bent in a direction in which the curvature radius decreases. However, the curvature radius does not significantly change on the mount base 60 because drying of the short width paper sheet P2 advances.

According to the present modification, in addition to the effects (1) to (6) of the aforementioned embodiment, the following effect is obtained. (7) A previously mounted long width paper sheet P1 is corrected to an appropriate curved shape by the projection rib 66 with a height according to the dimension in the width direction X, and thus by maintaining the rib height, the short width paper sheet P2 discharged next is mounted to overlap with the long width paper sheet P1 and is corrected to an appropriate curved shape.

In the aforementioned embodiment, it is preferable that a measurement section be included that measures an elapsed time since the paper sheet P is mounted on the mount surface 61 and that the projection mechanism 70 adjust the projection rib 66 so that the rib height becomes the lowest when the elapsed time measured by the measurement section indicates a time at which the ink adhering to the recording surface Pa has dried. In the present modification, the controller 50 functions as the time measurement section 57 (see FIG. 1). The present modification will be described with reference to the drawings.

Figure 9A:
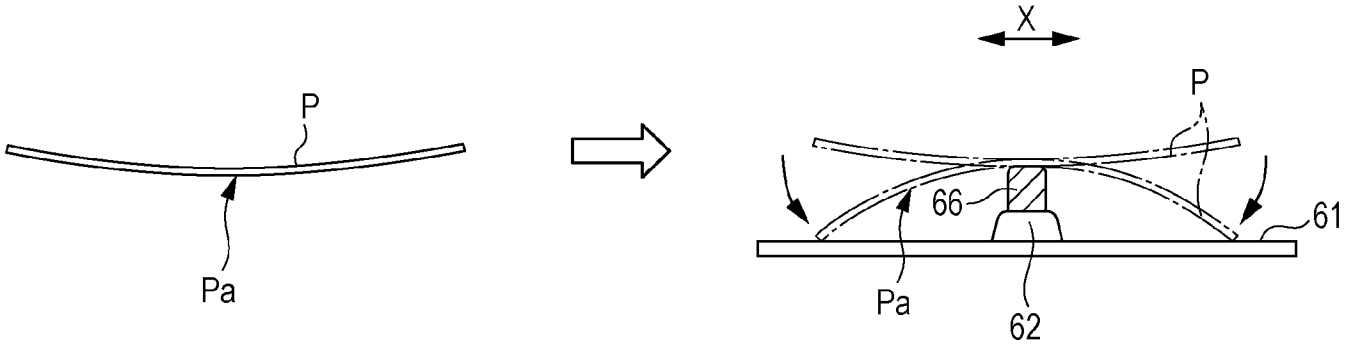
FIG. 9A is a schematic diagram illustrating a state where a sheet in a first curled state is mounted on the mount base.

As illustrated in FIG. 9A, in the first curled state where the lower recording surface Pa expands and forms a convex surface, the paper sheet P discharged through the medium discharge outlet 26 is mounted on the mount surface 61 with the projection rib 66 projected as illustrated on the right side of FIG. 9A, and thereby the first curl of the paper sheet P is corrected.

Figure 9B:
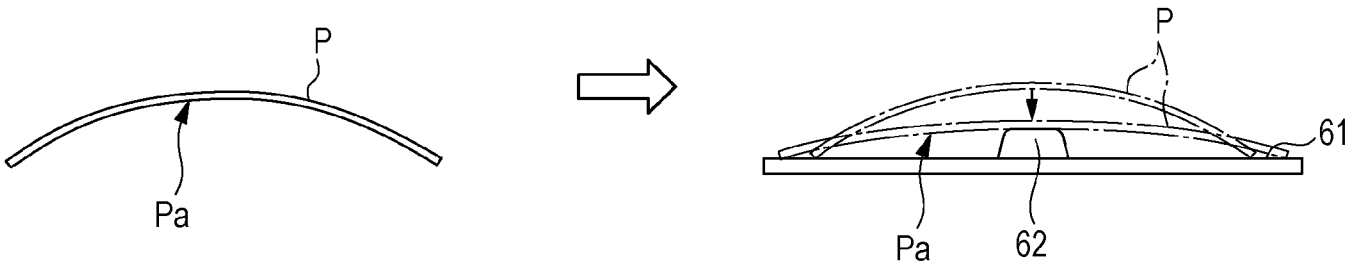
FIG. 9B is a schematic diagram illustrating a state where a sheet in a second curled state is mounted on the mount base.

On the other hand, as illustrated in FIG. 9B, in the paper sheet P having the recording surface Pa forming a convex surface in the first curled state, as the ink (solvent) adhering to the recording surface Pa evaporates and drying advances with the passage of time, the recording surface Pa shrinks this time, and thus forms a concave surface in the second curled state. Therefore, the paper sheet P, which has assumed the second curled state, is mounted on the mount surface 61 with the projection rib 66 not projected as illustrated on the right side of FIG. 9B, and is pressed against the mount surface 61 (projection section 62) by a paper sheet P (not illustrated) which is stacked on the paper sheet P in the second curled state, and thereby the second curl of the paper sheet P is corrected.

Thus, in the present modification, the projection mechanism controller 55, for which the controller 50 functions, controls the projection mechanism 70 to lower the projection rib 66 so as not to project from the projection section 62. Specifically, the time measurement section 57, for which the controller 50 functions, detects that the paper sheet P is mounted on the mount surface 61 (mount base 60), by a detector (not illustrated) provided in the printer 11. The time measurement section 57 then measures an elapsed time since the paper sheet P is mounted on the mount surface 61, and adjusts the projection rib 66 so that the rib height becomes the lowest, in short, adjusts the rib height so that the projection rib 66 does not project from the projection section 62 when the elapsed time indicates a time at which the ink adhering to the recording surface Pa is dried and the second curl occurs.

In the present modification, it is preferable that the air blower 80 stop blowing air when the elapsed time measured by the time measurement section 57 indicates a time at which the ink adhering to the recording surface Pa is dried. Here, the controller 50 stops the rotation of the rotary fan 81 to stop blowing air.

According to the present modification, in addition to the effects (1) to (6) in the aforementioned embodiment, the following effects are obtained. (8) When the first curl, in which the recording surface Pa forms a convex surface and is curled, comes to an end, unnecessary correction of the first curl may be cancelled. Consequently, it is possible to suppress the second curl, in which the recording surface Pa forms a concave surface and is curled.

(9) When the first curl, in which the recording surface forms a convex surface and is curled, comes to an end, unnecessary correction of the first curl by air blowing may be cancelled. Consequently, it is possible to suppress the second curl, in which the recording surface forms a concave surface and is curled.

In the aforementioned embodiment, it is preferable that a thickness acquisition section 56 be included that obtains the thickness of the paper sheet P on which the recording section 14 records and that the projection mechanism 70 adjust the rib height according to the thickness of the paper sheet P obtained by the thickness acquisition section 56. In the present modification, the controller 50 functions as the thickness acquisition section 56 (see FIG. 1) that obtains the thickness of the paper sheet P discharged through the medium discharge outlet 26. The controller 50 controls the projection mechanism 70 according to the obtained thickness of the paper sheet P and adjusts the rib height of the projection rib 66 set.

Specifically, the thickness acquisition section 56, for which the controller 50 functions, detects the thickness of the paper sheet P by a detector (not illustrated) provided in the printer 11. The projection mechanism controller 55, for which the controller 50 functions, adjusts the rib height of the projection rib 66 which is set before the paper sheet P is mounted on the mount surface 61. It is to be noted that, in the present modification, a thick paper sheet P is assumed to have a smaller degree of curl than a thin paper sheet P. When the detected thickness of the paper sheet P is thicker than a reference value, the controller 50 adjusts the rib height of the projection rib 66 to a lower height, and when the detected thickness is thinner than the reference value, the controller 50 adjusts the rib height of the projection rib 66 to a higher height.

According to the present modification, in addition to the effects (1) to (6) in the aforementioned embodiment, the following effect is obtained. (10) When the degree of curl varies according to the thickness of the paper sheet P, the curl of the paper sheet P is accurately correctable by the projection rib 66 with a height adjusted according to the degree of curl that occurs according to the thickness.

In the aforementioned embodiment, it is preferable that the projection mechanism 70 adjust the rib height of the projection rib 66 according to the length of the paper sheet P along the discharge direction Y, discharged through the medium discharge outlet 26. The paper sheets P discharged to the mount base 60 include paper sheets having different sheet lengths along the discharge direction Y and yet having the same widthwise dimension. Thus, in the present modification, the rib height of the projection rib 66, which is set according to the widthwise dimension of the paper sheet P, is adjusted according to the length of the paper sheet P along the discharge direction Y.

Specifically, the controller 50 obtains the dimension (widthwise dimension) of the paper sheet P in the width direction X and the length (lengthwise dimension) in the transport direction based on the sheet size obtained in the processing in step S1. The projection mechanism controller 55, for which the controller 50 functions, the rib height of the projection rib 66, which has been set in accordance with the widthwise dimension, is adjusted according to the lengthwise dimension before the paper sheet P is mounted on the mount surface 61. It is to be noted that, in the present modification, in the case where the lengthwise dimension of the paper sheet P is larger than the widthwise dimension of the paper sheet P, the degree of curl is smaller compared with the case where the lengthwise dimension of the paper sheet P is smaller than the widthwise dimension of the paper sheet P. Therefore, when the detected lengthwise dimension of the paper sheet P is smaller than the widthwise dimension of the paper sheet P, the controller 50 maintains the rib height of the projection rib 66, whereas when the lengthwise dimension is larger than the widthwise dimension of the paper sheet P, the controller 50 adjusts the rib height of the projection rib 66 to a lower height.

According to the present modification, in addition to the effects (1) to (6) in the aforementioned embodiment, the following effect is obtained. (11) The height of the rib that is projected according to the dimension of the paper sheet P in the width direction X is further adjusted according to the length in the discharge direction Y. Therefore, curl is accurately correctable by the projection rib 66 with a height adjusted according to a degree of the curl that varies with the length (length of the paper sheet P) in the discharge direction.

In the aforementioned embodiment, the recording section 14 is not limited to have a configuration of so-called line head that includes a liquid discharge head capable of discharging ink to substantially the whole area of the paper sheet P in the width direction X. For instance, the recording section 14 may have a configuration of so-called serial head that includes a liquid discharge head that ejects ink to a carriage that moves back and forth in a direction crossing the transport direction of the paper sheet P.

In the aforementioned embodiment, the projection rib 66 is not necessarily provided to have a length extended from the paper sheet P mounted on the mount surface 61 to the downstream side of the paper sheet P in the discharge direction Y. For instance, the projection rib 66 may be provided to have a length at the same position as the outer peripheral edge Pe on the downstream side of the paper sheet P in the discharge direction Y. Alternatively, as long as the paper sheet P is supported from the side in the gravitational direction in the vertical direction and can be curved so that curl of the paper sheet P is corrected, the projection rib 66 may be provided to have a length up to a position displaced toward the medium discharge outlet 26 from the outer peripheral edge Pe in the discharge direction Y.

In the aforementioned embodiment, the controller 50 does not necessarily adjust the preset rib height of the projection rib 66 according to the liquid volume rate (print duty) of ink ejected from the recording section 14 to the paper sheet P. For instance, in the case where the degree of curl of the paper sheet P is approximately the same without depending on the print duty, it is not necessary to adjust the preset rib height of the projection rib 66 according to the print duty. In this case, originally, the processing in step S3 and step S5 in FIG. 6 is unnecessary.

In the aforementioned embodiment, the mount base 60 is not necessarily provided with the projection section 62 at the center of the paper sheet P in the width direction X crossing the discharge direction Y of the paper sheet P. In other words, a configuration may be adopted in which the mount base 60 is a flat surface in the width direction X and the projection mechanism 70 is such that the projection rib 66 projects upward from the mount surface 61 (the first mount surface 61A) which is a flat surface.

In the aforementioned embodiment, the printer 11 is not necessarily provided with the air blower 80. In the case where the air blower 80 is not provided originally, when the elapsed time measured by the time measurement section 57 indicates a time at which the ink adhering to the recording surface Pa is dried, stopping of air blowing by the air blower 80 may not be performed.

Second Embodiment

In a second embodiment, a printer will be described in which the projected position of the projection rib 66 is set to the uppermost position or the lowermost position according to a result of comparison between the length of the paper sheet P in the width direction X and a predetermined value. Furthermore, in the printer in the second embodiment, the projected position of the projection rib 66 is set to the uppermost position or the lowermost position according to a result of comparison between the liquid volume rate (print duty) of ink and a predetermined value.

Figure 10:
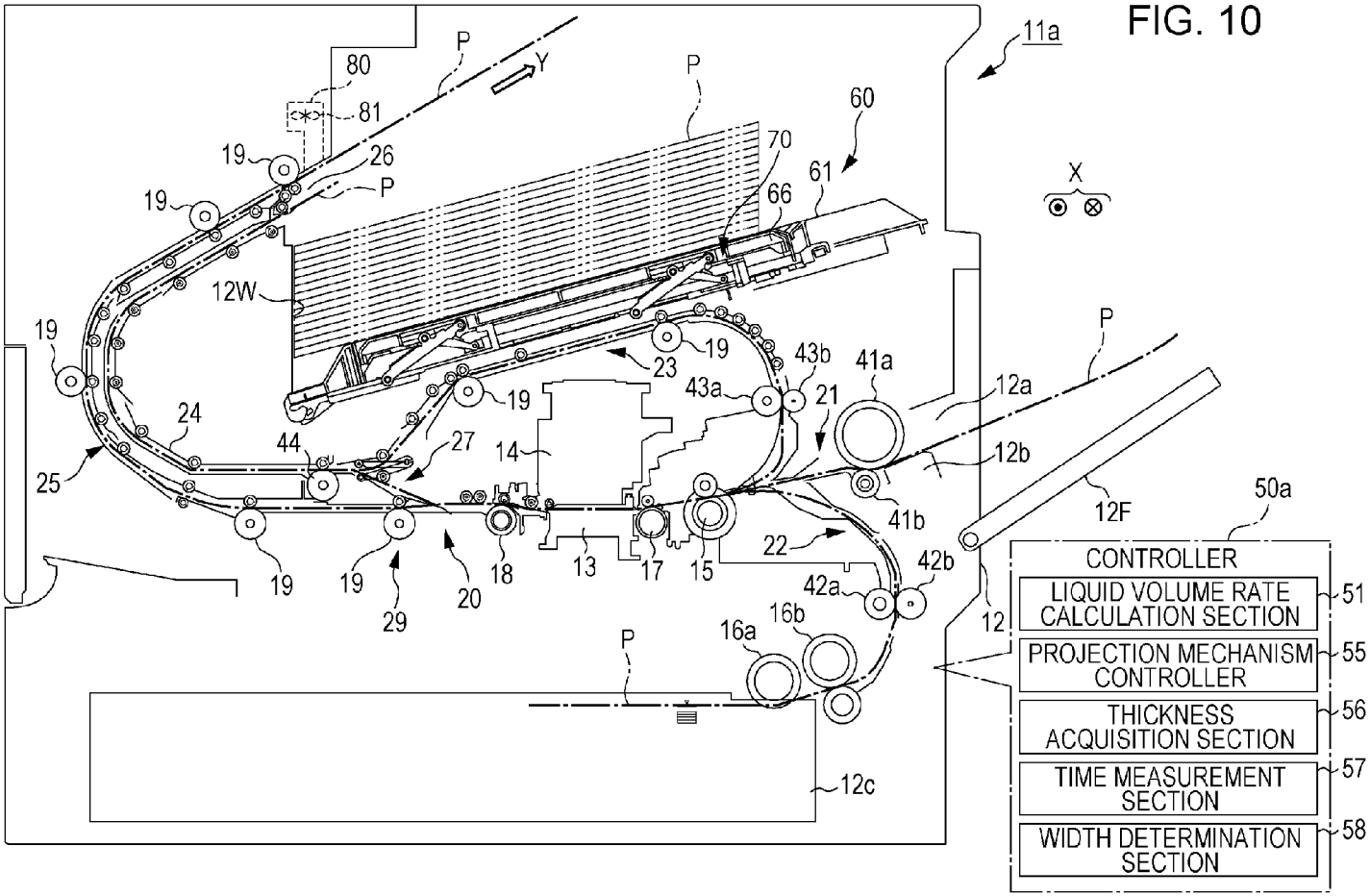
FIG. 10 is a structural diagram schematically illustrating a printer according to a second embodiment.

FIG. 10 is a structural diagram schematically illustrating a printer 11*a* as a recording apparatus in the present embodiment. In FIG. 10, a width determination section 58 is added to the structural diagram in FIG. 1 that schematically illustrates the printer 11. A controller 50*a* of the printer 11*a* in the present embodiment has a function as the width determination section 58 that makes determination by comparing between a predetermined value of length (dimension) of paper sheet in the width direction X and the length (dimension) of the paper sheet P in the width direction X.

A computer (not illustrated), in which a printer driver is installed and which serves as an information processing apparatus, is disposed as a separate body outside the printer 11*a*. The printer 11*a* is able to receive information on printing conditions such as a sheet size, the orientation of the sheet, and discharge data of ink from the printer driver by a wireless or wired communication unit.

A storage section (not illustrated) of the printer 11*a* prestores predetermined values for dimensions of paper in the width direction X and liquid volume rates of ink. For instance, 257 mm, which is the longer side dimension of B5 size paper, is stored as a predetermined value for dimension of paper sheet in the width direction X, and 10% is stored as a predetermined value of print duty (liquid volume rate of ink).

When the projection rib 66 is at the lowermost position, the upper end of the projection rib 66 is at the position of the upper end of the projection section 62, and the projection rib 66 is not projected from the projection section 62. The projection section 62 projects from the mount surface 61. Therefore, when the paper sheet P is mounted on the mount base 60 with the projection rib 66 at the lowermost position, the paper sheet P comes into contact with the upper end of the projection section 62, and thus a space is formed between the paper sheet P and the mount surface 61 on both sides of the projection section 62 in the width direction X. A user can remove the paper sheet P by inserting his/her finger in the space formed between the mount surface 61 and the paper sheet P.

Figure 11:
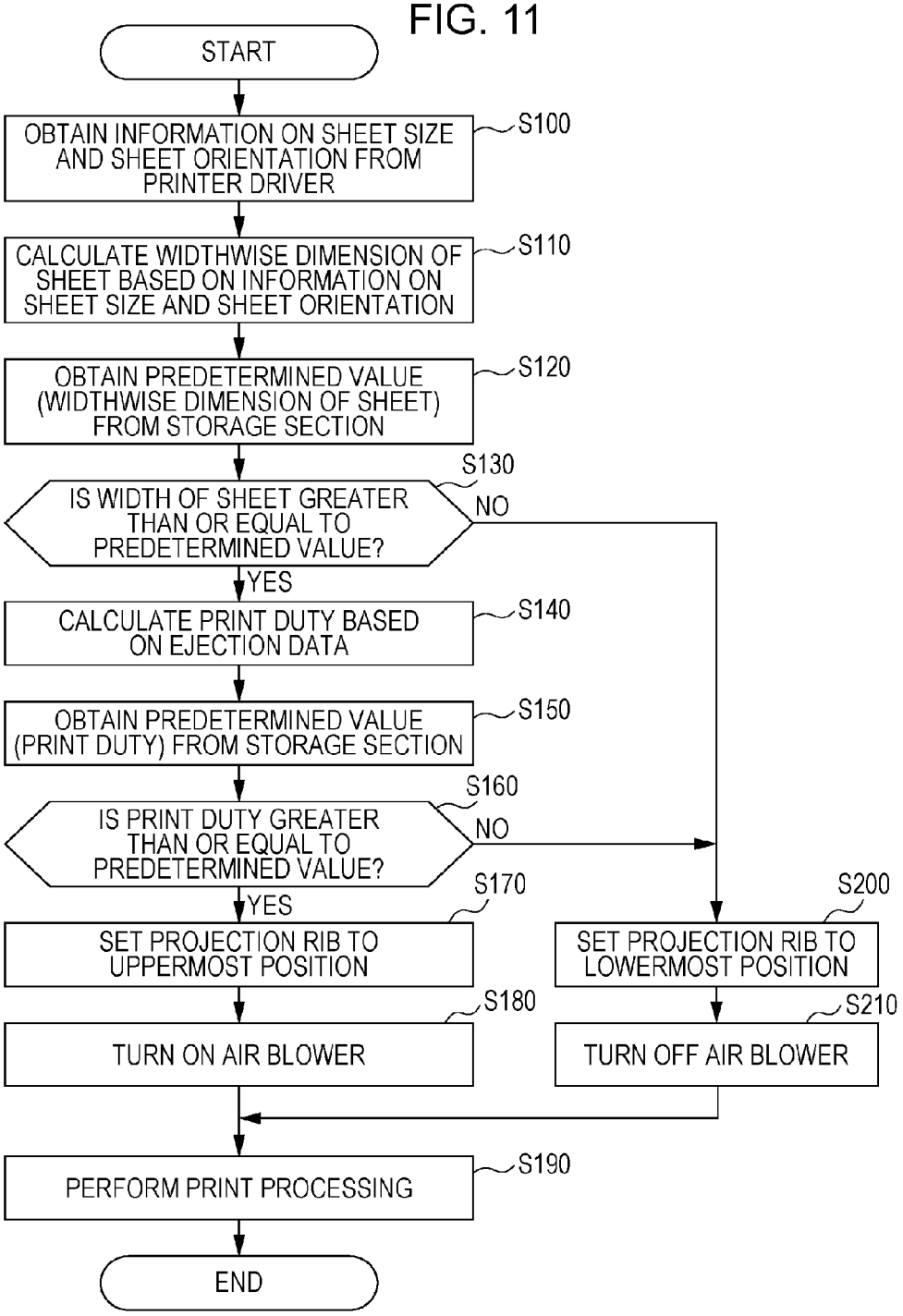
FIG. 11 is a flow chart illustrating print processing according to the second embodiment.

FIG. 11 is a flow chart illustrating print processing according to the present embodiment. A method of the print processing in the present embodiment will be described with reference to the flow chart of FIG. 11.

In step S100, the controller 50*a* obtains information on sheet size and orientation of sheet from the printer driver. In step S110, the controller 50*a* calculates the dimension of paper sheet P in the width direction X based on the information on sheet size and orientation of sheet obtained in step S100. In step S120, the width determination section 58 obtains a predetermined value (dimension of the paper sheet in the width direction X) from the storage section.

In step S130, the width determination section 58 determines whether or not the dimension of the paper sheet P in the width direction X calculated in step S110 is greater than or equal to a predetermined value obtained in step S120. When the dimension of the calculated paper sheet P in the width direction X is greater than or equal to the predetermined value (Yes), the flow proceeds to step S140, and when the dimension of the calculated paper sheet P in the width direction X is less than the predetermined value (No), the flow proceeds to step S200.

In step S200, the projection mechanism controller 55 (see FIG. 10) sets the projection rib 66 to the lowermost position. In step S210, the controller 50*a* turns off each blower 80, and the flow proceeds to step S190.

In step S190, the controller 50*a* performs print processing and terminates the processing. Specifically, the controller 50*a* causes the recording section 14 to discharge ink for performing recording while transporting paper sheet P, and discharges the paper sheet P through the medium discharge outlet 26.

In step S140, the liquid volume rate calculation unit 51 (see FIG. 10) calculates a liquid volume rate of ink, in other words, a print duty based on the discharge data. In step S150, the controller 50*a* obtains a predetermined value (liquid volume rate of ink) from the storage section.

In step S160, the controller 50*a* determines whether or not the print duty of ink calculated in step S140 is greater than or equal to the predetermined value obtained in step S150. When the calculated print duty is greater than or equal to the predetermined value (Yes), the flow proceeds to step S170, and when the calculated print duty is less than the predetermined value (No), the flow proceeds to step S200.

In step S170, the projection mechanism controller 55 sets the projection rib 66 to the uppermost position. In step S180, the controller 50*a* turns on the air blower 80 and the flow proceeds to step S190. In step S190, the controller 50*a* performs print processing and terminates the processing as described above.

The printer 11*a* described in the present embodiment in the above includes the width determination section 58 as a determination section that makes determination by comparing between the length of the paper sheet P in the width direction X and a predetermined value. When a determination result by the width determination section 58 indicates that the length of the paper sheet P in the width direction X is greater than or equal to a predetermined value (the determination result in step S130 is Yes), the projection mechanism controller 55 as a controller causes the projection rib 66 to project from the projection section 62 as a projection section (step S170). When the determination result by the width determination section 58 indicates that the length of the paper sheet P in the width direction X is less than a predetermined value, the projection mechanism controller 55 controls the projection rib 66 so that the projection rib 66 does not project from the projection section 62 (step S200).

With this configuration, when the length of the paper sheet P in the width direction X is greater than or equal to a predetermined value, curl of the paper sheet P is correctable.

In addition, the controller 50*a* of the printer 11*a* includes a liquid volume rate calculation section 51 as a calculation section that calculates a liquid volume rate of ink, specifically, a ratio (print duty) of the area to which ink is ejected with respect to the unit area of the paper sheet P, using print data. When a determination result by the width determination section 58 indicates that the length of the paper sheet P in the width direction X is greater than or equal to a predetermined value (the determination result in step S130 is Yes), and the ratio of the area is greater than or equal to a predetermined value (the determination result in step S160 is Yes), the projection mechanism controller 55 causes the projection rib 66 to project from the projection section 62 (step S170).

With this configuration, when the length of the paper sheet P in the width direction X is greater than or equal to a predetermined value, and the liquid volume rate of ink exceeds a predetermined value, curl of the paper sheet P is correctable by causing the projection rib 66 to project from the projection section 62. The other configurations of the printer 11*a* in the present embodiment is the same as those of the printer 11 described in the first embodiment.

Third Embodiment

In a third embodiment, a printer will be described in which the projected position of the projection rib 66 is set to the uppermost position or the lowermost position by the setting of image quality mode and the selection of alignment mode.

The printer in the present embodiment has a mechanism that performs low-speed transport printing in which the paper sheet P is transported at a low speed and printed, and a mechanism that performs high-speed transport printing in which the paper sheet P is transported at a high speed and printed.

The printer in the present embodiment is capable of selectively performing printing in normal image quality mode and printing in high image quality mode which is higher in quality than the normal image quality mode.

In addition, the printer in the present embodiment allows setting of alignment mode in which a plurality of print sheets P mounted in a stack on the mount base 60 is aligned. When alignment mode is set, transport speed of paper sheets is set to be lower than the transport speed when alignment mode is not set.

When paper sheets P are continuously discharged successively through the medium discharge outlet 26 of FIG. 2 and mounted on the mount surface 61, while a paper sheet P previously discharged through the medium discharge outlet 26 is moving in the opposite direction to the discharge direction Y along the slope of the mount surface 61, a paper sheet P subsequently discharged through the medium discharge outlet 26 may overlap on the previously discharged paper sheet P. For this reason, the previously discharged paper sheet P is unable to reach the vertical side wall 12W provided below the medium discharge outlet 26, and thus continuously discharged paper sheets P may not be aligned.

Thus, as described above, in the present embodiment, when the alignment mode is set, the transport speed of paper sheets is set to be low. Thus, a movement time is ensured for preceding paper sheet P to reach and come into contact with the vertical side wall 12W before subsequent paper sheet P overlaps with the preceding paper sheet P, the vertical side wall 12W being provided below the medium discharge outlet 26. Therefore, when paper sheets P are continuously discharged successively through the medium discharge outlet 26 and mounted on the mount surface 61, the position of the end of each paper sheet P in the opposite direction to the discharge direction Y is positioned by the vertical side wall 12W, and thus continuously discharged paper sheets P can be aligned.

Figure 12:
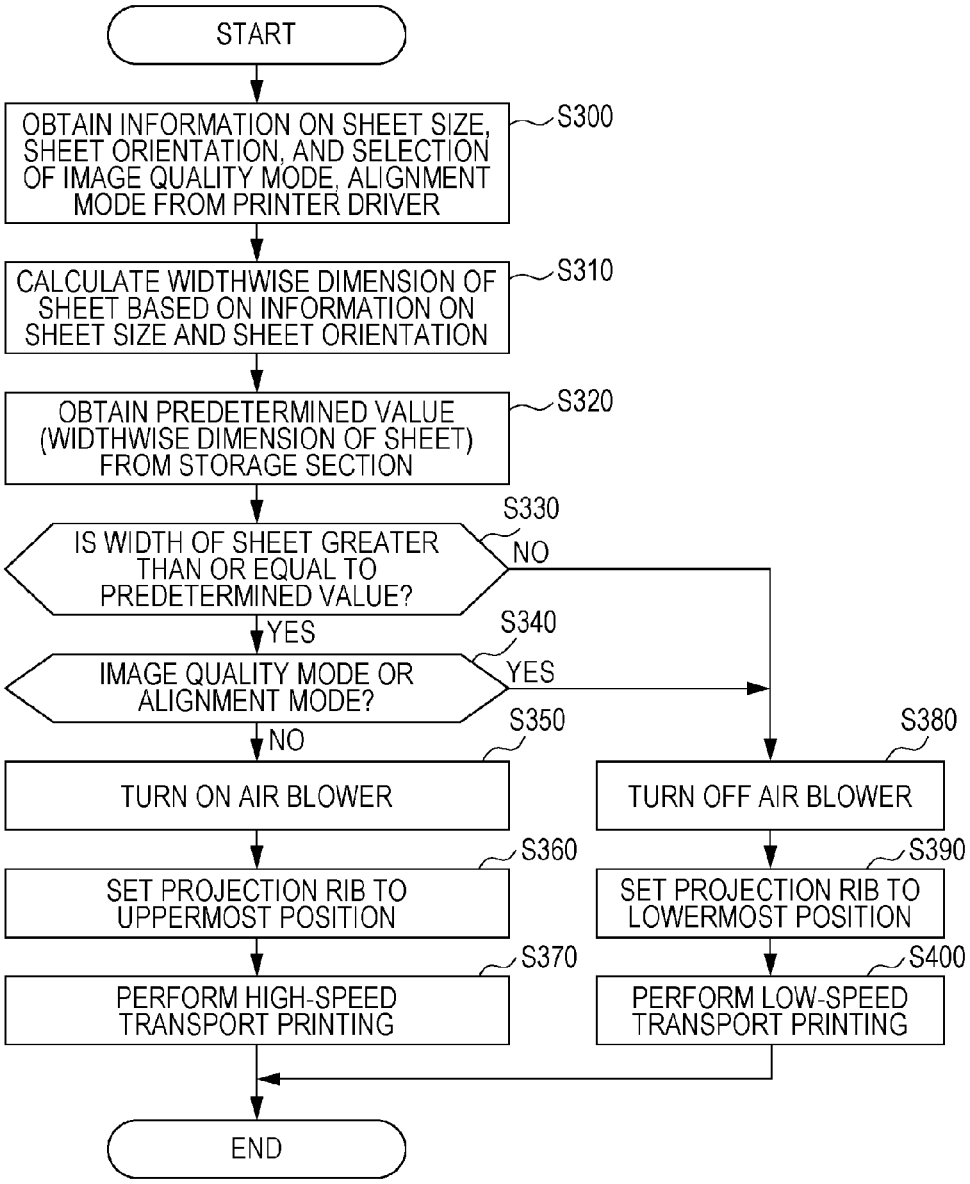
FIG. 12 is a flow chart illustrating print processing according to a third embodiment.

FIG. 12 is a flow chart illustrating print processing according to the present embodiment. A method of print processing in the present embodiment will be described with reference to the flow chart of FIG. 12.

In step S300, a control section 50*a* (see FIG. 10) obtains information on sheet size, orientation of sheet, image quality mode, and selection of alignment mode from the print driver. In step S310, the controller 50*a* calculates the dimension of the paper sheet P in the width direction X based on the information on sheet size, orientation of sheet obtained in step S300. In step S320, the width determination section 58 (see FIG. 10) obtains a predetermined value (dimension of the paper sheet in the width direction X) from the storage section.

In step S330, the width determination section 58 determines whether or not the dimension of the paper sheet P in the width direction X calculated in step S310 is greater than or equal to the predetermined value obtained in step S320. When the dimension of the paper sheet P in the width direction X is greater than or equal to the predetermined value (Yes), the flow proceeds to step S340, and when the dimension of the paper sheet P in the width direction X is less than the predetermined value (No), the flow proceeds to step S380.

In step S380, the controller 50*a* turns off the blower 80. In step S390, the projection mechanism controller 55 (see FIG. 10) sets the projection rib 66 to the lowermost position. In step S400, the controller 50*a* performs low-speed transport printing. Specifically, the controller 50*a* causes the recording section 14 to discharge ink for performing recording while transporting paper sheet P at a low speed, and discharges the paper sheet P through the medium discharge outlet 26.

In step S340, the controller 50*a* determines whether high image quality mode or alignment mode is selected in the information on image quality mode obtained in step S300. When a determination result in step S340 indicates that high image quality mode or alignment mode is selected (Yes), the flow proceeds to step S380.

When a determination result in step S340 indicates that high image quality mode or alignment mode is not selected (No), in other words, when normal image quality mode is set and alignment mode is not set, the flow proceeds to step S350.

In step S350, the controller 50*a* turns on the blower 80. In step S360, the projection mechanism controller 55 (see FIG. 10) sets the projection rib 66 to the uppermost position. In step S370, the controller 50*a* performs high-speed transport printing and terminates the processing. Specifically, the controller 50*a* causes the recording section 14 to discharge ink for performing recording while transporting paper sheet P at a high speed, and discharges the paper sheet P through the medium discharge outlet 26.

The printer described in the present embodiment in the above includes a recording mode that allows selection between normal image quality mode and high image quality mode which is higher in quality than the normal image quality mode. When a determination result by the width determination section 58 serving as a determination section indicates that the length of the paper sheet P in the width direction X is greater than or equal to a predetermined value (the determination result in step S330 is Yes), and the high image quality mode or the alignment mode is selected (the determination result in step S340 is Yes), the controller 50*a* does not cause the projection rib 66 to project from the projection section 62 (step S390) and causes the recording section 14 to perform recording while transporting the paper sheet P at a low speed (step S400).

With this configuration, when the length of the paper sheet P in the width direction X is greater than or equal to a predetermined value and the high image quality mode or the alignment mode is selected, the paper sheets P mounted on the mount base 60 are aligned. The other configurations of the printer in the present embodiment is the same as those of the printer 11 described in the first embodiment.

Fourth Embodiment

In a fourth embodiment, a printer will be described in which the projected position of the projection rib 66 is set to the uppermost position or the lowermost position according to a grammage. A storage section (not illustrated) of the printer in the present embodiment prestores predetermined values of sheet grammage (the grammage of medium) that is defined as the ratio of the weight of a sheet to the area of the sheet. For instance, 90 g/m$^2$ is stored in the storage section as a predetermined value of sheet grammage.

Figure 13:
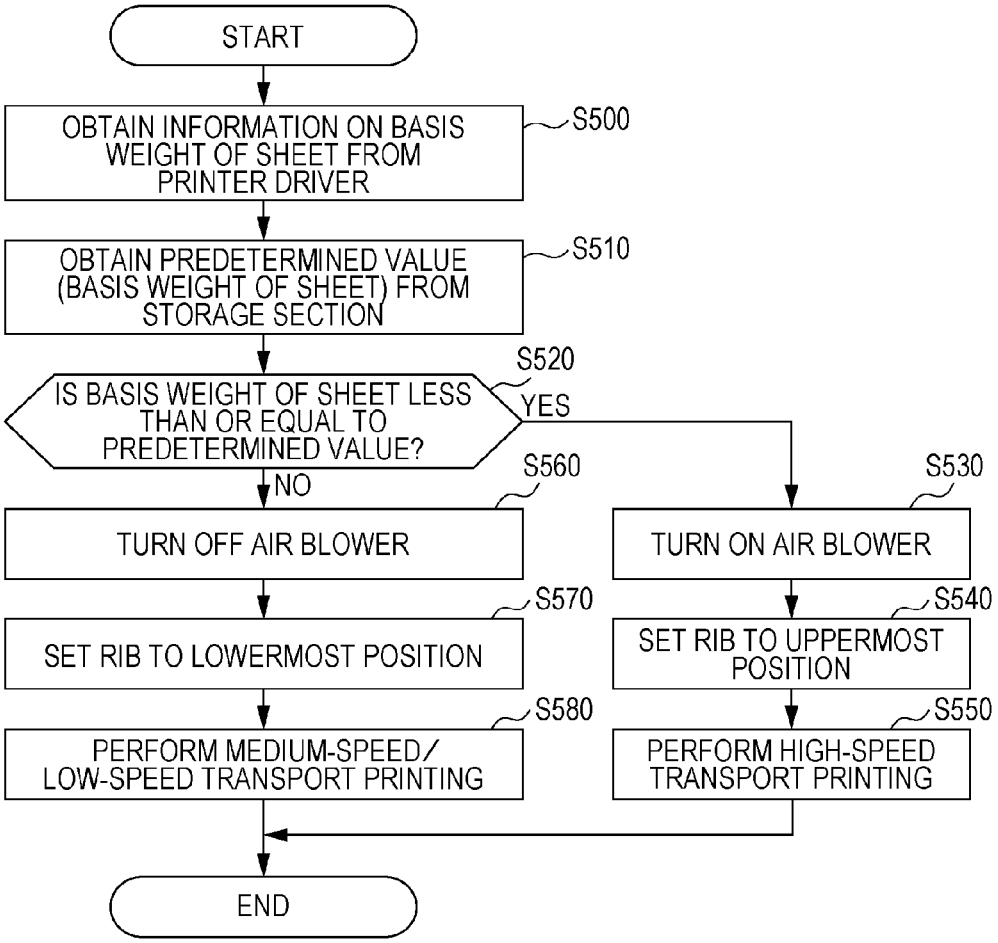
FIG. 13 is a flow chart illustrating print processing according to a fourth embodiment.

FIG. 13 is a flow chart illustrating print processing according to the present embodiment. A method of print processing in the present embodiment will be described with reference to the flow chart of FIG. 13.

In step S500, the controller 50 (see FIG. 1) obtains information on sheet grammage from the print driver. In step S510, the controller 50 obtains a predetermined value (sheet grammage) from the storage section.

In step S520, the controller 50 determines whether or not the sheet grammage obtained in step S500 is less than the predetermined value obtained in step S510. When the obtained sheet grammage is less than the predetermined value (Yes), the flow proceeds to step S530, and when the obtained sheet grammage is not less than the predetermined value, in other words, the obtained sheet grammage exceeds the predetermined value (No), the flow proceeds to step S560.

In step S530, the controller 50 turns on the blower 80. In step S540, the projection mechanism controller 55 (see FIG. 1) sets the projection rib 66 to the uppermost position, and the flow proceeds to step S550. In step S550, the controller 50 performs high-speed transport printing. Specifically, the controller 50 causes the recording section 14 to discharge ink for performing recording while transporting paper sheet P at a high speed, and discharges the paper sheet P through the medium discharge outlet 26.

In step S560, the controller 50 turns off the blower 80. In step S570, the projection mechanism controller 55 (see FIG. 1) sets the projection rib 66 to the lowermost position. In step S580, the controller 50 performs medium-speed or high-speed transport printing and terminates the processing. Specifically, the controller 50 causes the recording section 14 to discharge ink for performing recording while transporting paper sheet P at a medium speed or a high speed, and discharges the paper sheet P through the medium discharge outlet 26. The other configurations of the printer in the present embodiment is the same as those of the printer 11 described in the first embodiment.

The printer described in the present embodiment in the above includes the controller 50 as a determination section that makes determination by comparing between the grammage of medium (sheet grammage) and a predetermined value, and the projection mechanism controller 55 as a controller that causes the projection rib 66 to project from the projection section 62 when a determination result by the controller 50 indicates that the sheet grammage is less than or equal to a predetermined value, and that controls the projection rib 66 so that the projection rib 66 does not project from the projection section 62 when a determination result by the controller 50 indicates that the sheet grammage is greater than a predetermined value.

With this configuration, when the sheet grammage is less than or equal to a predetermined value, the projection rib 66 is caused to project from the projection section 62, and thus curl of the paper sheet P is accurately correctable by the projection rib 66. The other configurations of the printer in the present embodiment is the same as those of the printer 11 described in the first embodiment.

Fifth Embodiment

Figure 14:
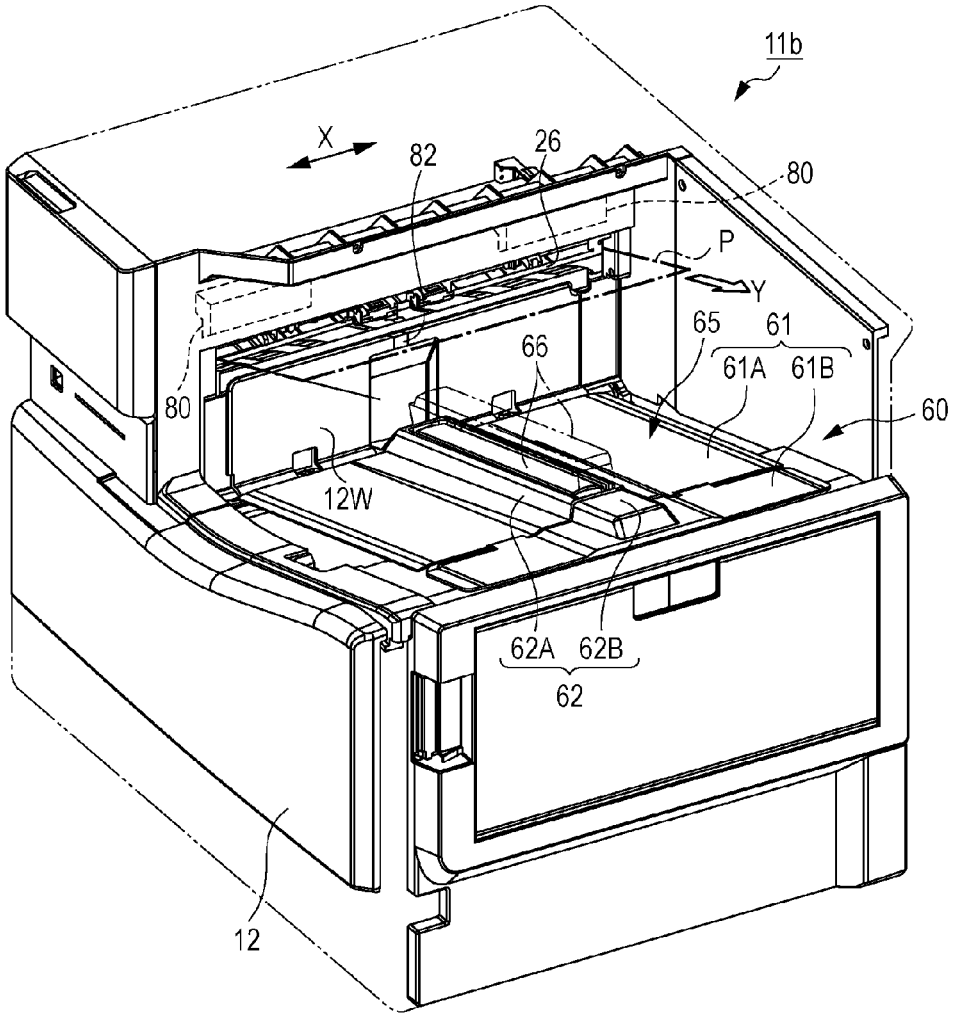
FIG. 14 is a structural perspective view of a print according to a fifth embodiment.

In a fifth embodiment, a printer will be described which includes a detector that detects a maximum loading amount of the mount base 60. FIG. 14 is a structural perspective view of print 11*b* according to the present embodiment. An optical sensor 82 as a detector is provided at a central portion in the width direction X of an upper portion of the vertical side wall 12W. The optical sensor 82 is located below the medium discharge outlet 26 and the surface of the optical sensor 82 on the downstream side in the discharge direction Y does not project from the vertical side wall 12W. Therefore, when paper sheet P is discharged through the medium discharge outlet 26 and falls to the mount base 60, the paper sheet P does not come into contact with the optical sensor 82.

When paper sheets P are successively discharged through the medium discharge outlet 26, the height of the paper sheets P stacked on the mount base 60 increases. The optical sensor 82 is capable of detecting that the height of the stacked paper sheets P reaches the position of an upper portion of the vertical side wall 12W. In other words, the optical sensor 82 is capable of detecting that the amount of the paper sheets P stacked on the mount base 60 reaches a maximum. The printer in the present embodiment is capable of detecting by the optical sensor 82, for instance, a state where 500 paper sheets P are stacked, which indicates a maximum amount (maximum loading) of stacked paper sheets P.

The projection mechanism controller 55 can set the projection rib 66 stepwise down from the uppermost position to the lowermost position. In the present embodiment, one step down is set to be, for instance, approximately 5 mm lower position. Also, the projection mechanism controller 55 defines a numerical value for a parameter that indicates a step position of the projection rib 66, and stores the numerical value in the storage section (not illustrated). The projection mechanism controller 55, when lowering the projection rib 66 by one step, subtracts a numerical value corresponding to one step and stores the result of subtraction in the storage section.

Figure 15:
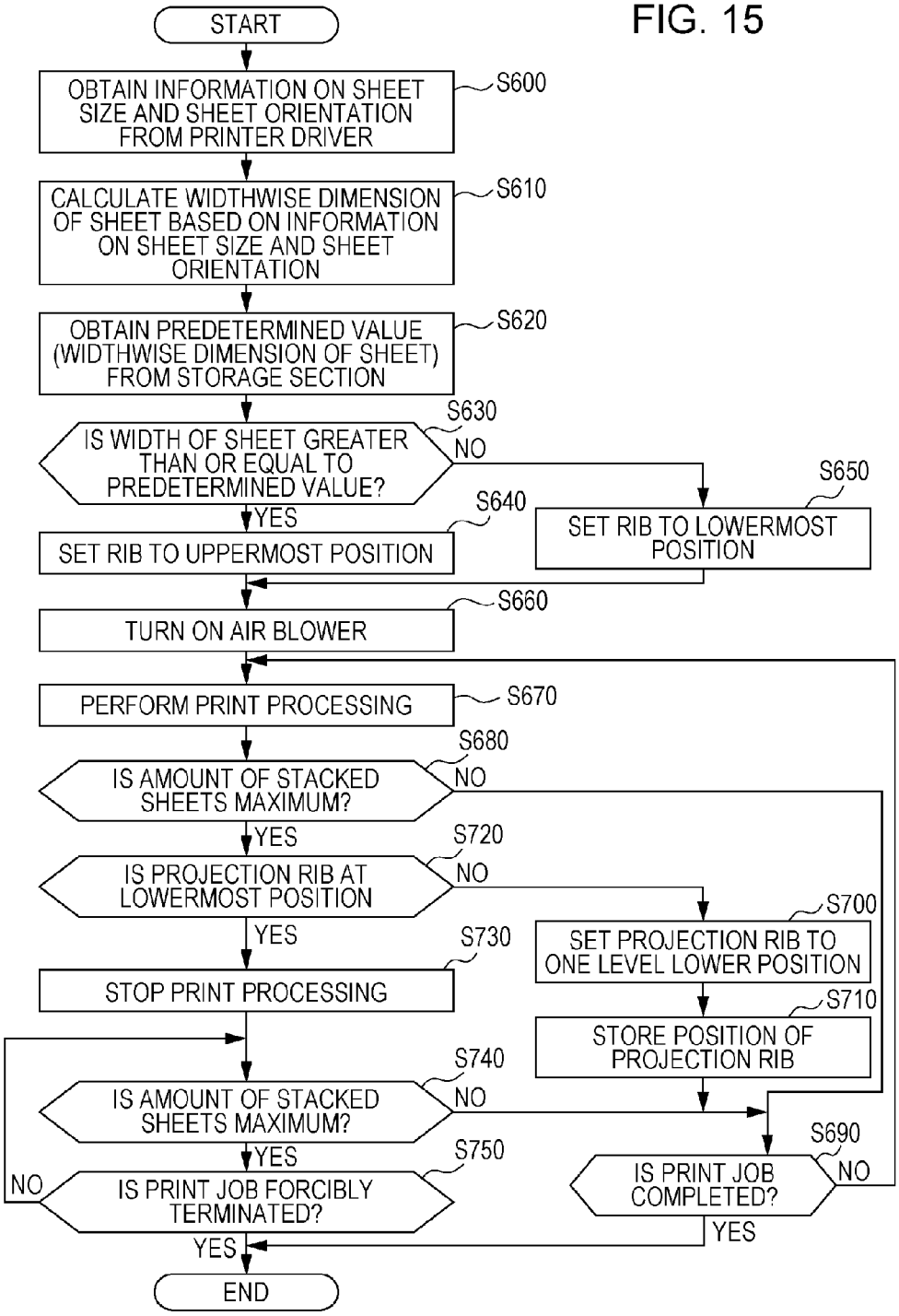
FIG. 15 is a flow chart illustrating print processing according to the fifth embodiment.

FIG. 15 is a flow chart illustrating print processing according to the present embodiment. A method of print processing in the present embodiment will be described with reference to the flow chart of FIG. 15.

In step S600, the controller 50*a* (see FIG. 10) obtains information on sheet size and orientation of sheet from the printer driver. In step S610, the controller 50*a* calculates the dimension of the paper sheet P in the width direction X based on the information on sheet size, orientation of sheet obtained in step S600. In step S620, the width determination section 58 (see FIG. 10) obtains a predetermined value (dimension of the paper sheet in the width direction X) from the storage section.

In step S630, the width determination section 58 determines whether or not the dimension of the paper sheet P in the width direction X calculated in step S610 is greater than or equal to the predetermined value obtained in step S620. When the dimension of the paper sheet P in the width direction X is greater than or equal to the predetermined value (Yes), the flow proceeds to step S640, and when the dimension of the paper sheet P in the width direction X is less than the predetermined value (No), the flow proceeds to step S650. In step S650, the projection mechanism controller 55 (see FIG. 10) sets the projection rib 66 to the lowermost position.

In step S640, the projection mechanism controller 55 sets the projection rib 66 to the uppermost position, and in step S660, the controller 50*a* turns on the blower 80. In step S670, the controller 50*a* performs print processing. Specifically, the controller 50*a* causes the recording section 14 to perform printing on transported paper sheet P and performs processing of discharging the paper sheet P through the medium discharge outlet 26.

In step S680, the controller 50*a* uses the optical sensor 82 to determine whether or not the stack amount reaches a maximum. When the stack amount reaches a maximum (Yes), the flow proceeds to step S720. When the stack amount falls below a maximum (No), the flow proceeds to step S690.

In step S690, the controller 50*a* determines whether or not the print job is completed. When the print job is completed (Yes), the processing is terminated. When the print job is not completed (No), the flow returns to step S670, and the print processing is continuously performed.

In step S720, the controller 50*a* obtains a parameter, which indicates a step position of the projection rib 66, from the storage section (not illustrated), and determines whether or not the projection rib 66 is at the lowermost position. When the projection rib 66 is at the lowermost position (Yes), the flow proceeds to step S730, and when the projection rib 66 is not at the lowermost position (No), the flow proceeds to step S700.

In step S700, the projection mechanism controller 55 sets the projection rib 66 to the position one step lower. In step S710, the controller 50*a* subtracts a numerical value corresponding to one step from the value of the parameter as a numerical value, and stores the result of subtraction in the storage section as the parameter indicating the step position of the projection rib 66, and the flow proceeds to step S690.

In step S690, as described above, the controller 50*a* determines whether or not the print job is completed, and when the print job is completed (Yes), the processing is terminated. When the print job is not completed (No), the flow returns to step S670, and the print processing is continuously performed.

In step S730, the controller 50*a* stops the print processing. In step S740, the controller 50*a* uses the optical sensor 82 to determine whether or not the stack amount reaches a maximum. When the stack amount reaches a maximum (Yes), the flow proceeds to step S750. When the stack amount falls below a maximum (No), the flow proceeds to step S690.

In step S690, as described above, the controller 50*a* determines whether or not the print job is completed, and when the print job is completed (Yes), the processing is terminated. When the print job is not completed (No), the flow returns to step S670, and the print processing is continuously performed.

In step S750, the controller 50*a* determines whether or not the print job is forcibly terminated. When the print job is forcibly terminated (Yes), the processing is terminated, and when print job is not forcibly terminated, the flow returns to step S740 (No), and the controller 50*a* determines whether or not the stack amount reaches a maximum.

When paper sheet P mounted on the mount base 60 is removed by a user, the optical sensor 82 detects no paper sheet P. Therefore, in step S740, the controller 50*a* determines that the stack amount falls below a maximum (No), the flow proceeds to step S690. In step S690, when the print job is not completed, the flow returns to step S670, and the print processing is continuously performed.

The printer 11*b* described in the present embodiment in the above includes the optical sensor 82 as a detector that detects a maximum loading amount of the mount base 60, and in the case where a maximum loading amount is detected by the optical sensor 82 with the projection rib 66 projecting from the projection portion 62, the controller 50*a* lowers the projection rib 66. With this configuration, it is possible to increase the maximum loading amount of paper sheets P that can be mounted on the mount base 60.

Although predetermined values in the first to fifth embodiments are referred to the values stored in the storage section, the predetermined values may be set as parameters that are described by a program.

In the aforementioned embodiment, the supply source of ink, which is recording liquid ejected from the recording section 14, may be, for instance, an ink storage body provided inside the housing 12 of the printer 11. Alternatively, the supply source of ink may be what is called an external type ink storage body that is provided externally of the housing 12. Particularly in the case of an external type ink storage body, the capacity of ink can be increased, and thus it is possible to discharge more ink from the recording section 14.

It is to be noted that when ink is supplied to the recording section 14 from an ink storage body provided externally of the housing 12, it is necessary to draw an ink supply tube for supplying ink from the outside to the inside of the housing 12. Therefore, in this case, the housing 12 is preferably provided with a hole or a notch through which an ink supply tube may be inserted. Alternatively, the housing 12 may be provided with a space through which an ink supply tube may be drawn from the outside to the inside of the housing 12. In this manner, ink supply to the recording section 14 may be easily provided using the ink flow path for an ink supply tube.

In the aforementioned embodiment, the printer 11 as a recording apparatus may be a fluid ejection apparatus that performs recording by injecting or ejecting another fluid other than ink (including liquid, liquid state material obtained by dispersing or mixing particles of functional materials to or with liquid, fluid like a gel, and a solid that can be ejected as a fluid). For instance, the printer 11 may be a liquid state material ejection apparatus that performs recording by ejecting liquid state materials including materials such as electrode materials or color materials (pixel materials) in the form of dispersion or dissolution, used for manufacture of liquid crystal display, electroluminescence (EL) display, and surface emitting display. Also, the printer 11 may be a fluid ejection apparatus that ejects fluid such as a gel (for instance, a physical gel) or a powder material ejection apparatus (for instance, toner jet printing apparatus) that ejects solid, for instance, powder (powder material) such as toner. The invention is applicable to any one of these types of fluid ejection apparatus. It is to be noted that in the present description, "liquid" is the concept that does not include a fluid that contains only gas. The fluid includes, for instance, liquid (including an inorganic solvent, an organic solvent, a solution, a liquid state resin, and a liquid state metal (a metal melt)), a liquid state material, a fluid, and a powder and granular material (including a granular material, a powder material).

This application is a divisional application of U.S. patent application Ser. No. 14/870,877, filed Sep. 30, 2015, which patent application is incorporated herein by reference in its entirety. U.S. patent application Ser. No. 14/870,877 claims the benefit of and priority of Japanese Patent Application No. 2014-201241, filed Sep. 30, 2014 and the entire disclosure of Japanese Patent Application No. 2015-141078, filed Jul. 15, 2015 are expressly incorporated by reference herein.

What is claimed is:

1. A recording apparatus comprising:

a recording section that performs recording on a medium by discharging a liquid;

a transport path along which the medium, on which recording is performed by the recording section, is transported, the transport path being provided with a discharge outlet through which the medium is discharged with a recording surface on which recording is performed by the recording section immediately before the discharge facing in a gravitational direction in a vertical direction;

a mount base having a mount surface on which the medium discharged through the discharge outlet is mounted, the mount surface facing the recording surface of the medium;

a projection section that is provided in the mount base, projects from the mount surface, and that extends along a discharge direction of the medium discharged through the discharge outlet, through a center of the medium in a width direction crossing the discharge direction of the medium;

a rib that is projectable from an upper surface of the projection section;

a determination section that makes a determination by comparing a length of the medium in the width direction and a predetermined value; and a controller that causes the rib to project from the projection section when a determination result by the determination section indicates that the length of the medium in the width direction is greater than or equal to the predetermined value, and that controls the rib so that the rib does not project from the projection section when the determination result by the determination section indicates that the length of the medium in the width direction is less than the predetermined value.

2. The recording apparatus according to claim 1, further comprising a detector that detects a maximum loading amount of the mount base, wherein when the maximum loading amount is detected by the detector in a state where the rib projects from the projection section, the controller lowers the rib.

3. The recording apparatus according to claim 2, wherein when the maximum loading amount is detected by the detector in a state where the rib does not project from the projection section, the controller stops printing.

4. The recording apparatus according to claim 1, wherein the controller includes a calculation section that calculates a ratio of an area to which the liquid is ejected with respect to a unit area of the medium, using print data, and in the case where a determination result by the determination section indicates that the length of the medium in the width direction is greater than or equal to the predetermined value, when the ratio of the area is greater than or equal to a predetermined value, the controller causes the rib to project from the projection section, when the ratio of the area is less than the predetermined value, the controller does not cause the rib to project from the projection section.

5. The recording apparatus according to claim 1, further comprising a recording mode that allows selection between a normal image quality mode and a high image quality mode which is higher in quality than the normal image quality mode, wherein when a determination result by the determination section indicates that the length of the medium in the width direction is greater than or equal to the predetermined value, and the high image quality mode is selected, the controller does not cause the rib to project from the projection section and causes the recording section to perform recording by low-speed transport which is lower in speed than a transport speed in the normal image quality mode.

6. The recording apparatus according to claim 1, further comprising an alignment mode that is selectable and a plurality of media mounted in a stack on the mount base is aligned, wherein when a determination result by the determination section indicates that the length of the medium in the width direction is greater than or equal to the predetermined value, and the alignment mode is selected, the controller does not cause the rib to project from the projection section and causes the recording section to perform recording by low-speed transport which is lower in speed than a transport speed when the alignment mode is not selected.

7. A recording apparatus comprising:

a recording section that performs recording on a medium by discharging a liquid;

a transport path along which the medium, on which recording is performed by the recording section, is transported, the transport path being provided with a discharge outlet through which the medium is discharged with a recording surface on which recording is performed by the recording section immediately before the discharge facing in a gravitational direction in a vertical direction;

a mount base having a mount surface on which the medium discharged through the discharge outlet is mounted, the mount surface facing the recording surface of the medium;

a projection section that is provided in the mount base, projects from the mount surface, and that extends along a discharge direction of the medium discharged through the discharge outlet, through a center of the medium in a width direction crossing the discharge direction of the medium;

a rib that is projectable from an upper surface of the projection section;

a determination section that makes determination by comparing between a grammage of the medium and a predetermined value; and a controller that causes the rib to project from the projection section when a determination result by the determination section indicates that the grammage of the medium is less than the predetermined value, and that controls the rib so that the rib does not project from the projection section when the determination result by the determination section indicates that the grammage of the medium is greater than or equal to the predetermined value.

8. The recording apparatus according to claim 7, wherein the recording section includes a line head that may simultaneously eject the liquid over at least a range of recording area in a width direction of the medium crossing a transport direction of the medium which is transported along the transport path.

* * * * *